US006948632B2

(12) United States Patent
Kellogg et al.

(10) Patent No.: US 6,948,632 B2
(45) Date of Patent: Sep. 27, 2005

(54) COLLAPSIBLE STRUCTURE

(75) Inventors: Michael S. Kellogg, Oconomowoc, WI (US); Dean B. Krotts, Milwaukee, WI (US)

(73) Assignee: Bajer Design & Marketing, Inc., Pewaukee, WI (US)

( * ) Notice: Subject to any disclaimer, the term of this patent is extended or adjusted under 35 U.S.C. 154(b) by 0 days.

(21) Appl. No.: 10/413,925

(22) Filed: Apr. 15, 2003

(65) Prior Publication Data

US 2003/0189044 A1 Oct. 9, 2003

Related U.S. Application Data

(63) Continuation-in-part of application No. 09/834,437, filed on Apr. 13, 2001, now abandoned, which is a continuation-in-part of application No. 09/698,674, filed on Oct. 27, 2000, now Pat. No. 6,494,335, which is a continuation-in-part of application No. 09/393,956, filed on Sep. 10, 1999, now abandoned, and a continuation-in-part of application No. 09/108,521, filed on Jul. 1, 1998, now Pat. No. 5,971,188.

(51) Int. Cl.[7] ..... B65D 25/00
(52) U.S. Cl. ..... 220/9.4; 135/125; 220/9.2
(58) Field of Search ..... 220/9.2, 9.4, 9.3; 135/125, 128; 383/119

(56) References Cited

U.S. PATENT DOCUMENTS

| | | | |
|---|---|---|---|
| 177,749 | A | 3/1876 | Redden |
| 216,227 | A | 6/1879 | Sedgwick |
| 217,362 | A | 7/1879 | Gardner |
| 218,277 | A | 8/1879 | Kilham |
| 251,325 | A | 12/1881 | Walters |
| 338,892 | A | 3/1886 | Walker |
| 334,340 | A | 6/1886 | Barrow |
| 356,301 | A | 1/1887 | Belknap |
| 414,622 | A | 11/1889 | Willits |
| 481,957 | A | 9/1892 | Klank |
| 665,942 | A | 1/1901 | Tabler |
| 929,430 | A | 7/1909 | Hill |
| 945,918 | A | 1/1910 | Crawford |
| 975,745 | A | 11/1910 | Bower |
| 1,087,702 | A | 2/1914 | Van Patten |
| 1,135,892 | A | 4/1915 | Grosenbeck |
| 1,144,643 | A | 6/1915 | Elkins |
| 1,155,475 | A | 10/1915 | Fay |
| 1,167,497 | A | 1/1916 | Hayes |
| 1,180,574 | A | 4/1916 | Despot |
| 1,181,829 | A | 5/1916 | Bower |
| 1,206,618 | A | 11/1916 | Thrasher |
| 1,251,560 | A | 1/1918 | Myskow |
| 1,263,294 | A | 4/1918 | Taylor |
| 1,308,268 | A | 7/1919 | Wagner et al. |
| 1,360,844 | A | 11/1920 | Williams |
| 1,394,007 | A | 10/1921 | Hall |
| 1,520,532 | A | 12/1924 | Clark |
| 1,538,260 | A | 5/1925 | Street et al. |

(Continued)

FOREIGN PATENT DOCUMENTS

| | | |
|---|---|---|
| DE | 2015649 | 2/1971 |
| DE | 30 13 178 | 11/1981 |
| DE | 41 14 916 | 11/1991 |
| FR | 1380728 | 10/1964 |
| FR | 1380738 | 10/1964 |
| FR | 2635136 | 2/1990 |
| GB | 1367 | 5/1871 |
| JP | 6-42227 | 2/1994 |

*Primary Examiner*—Joseph C. Merek
(74) *Attorney, Agent, or Firm*—Ryan Kromholz & Manion, S.C.

(57) ABSTRACT

A collapsible structure having a plurality of side panels and a floor panel forming an enclosure having an open top. Each side panel comprises a two-ply web of material and a continuous loop frame. One or more handles may be attached to the structure or formed within one or more of the side panels. A method of making and collapsing the structure is also disclosed.

14 Claims, 32 Drawing Sheets

U.S. PATENT DOCUMENTS

| | | | | | |
|---|---|---|---|---|---|
| 1,581,888 | A | | 4/1926 | Thomas | |
| 1,583,083 | A | | 5/1926 | Macaraig | |
| 1,640,083 | A | | 8/1927 | Ladd | |
| 1,647,679 | A | | 11/1927 | Williams | |
| 1,691,904 | A | | 11/1928 | Gamble | |
| 1,703,066 | A | | 2/1929 | Horn | |
| 1,836,297 | A | | 12/1931 | Vienna | |
| 1,979,978 | A | | 11/1934 | Martin | |
| 1,994,235 | A | | 3/1935 | Solomon | |
| 1,999,424 | A | | 4/1935 | Seitz | |
| 2,009,035 | A | | 7/1935 | Towers | |
| 2,042,888 | A | | 6/1936 | Flood | |
| 2,057,942 | A | | 10/1936 | Fay | |
| 2,071,850 | A | | 2/1937 | Miller | |
| 2,115,308 | A | | 4/1938 | Koch | |
| 2,136,761 | A | | 11/1938 | Simmons | |
| 2,182,932 | A | | 12/1939 | Sanford | |
| 2,269,574 | A | | 1/1942 | Benenfeld | |
| 2,280,601 | A | | 4/1942 | Otter | |
| 2,295,584 | A | | 9/1942 | Larson | |
| 2,298,786 | A | | 10/1942 | Dubofsky et al. | |
| 2,361,743 | A | | 10/1944 | Butler | |
| 2,544,074 | A | | 3/1951 | Ernst et al. | |
| 2,575,893 | A | | 11/1951 | Seaman | |
| 2,600,501 | A | | 6/1952 | Higgs | |
| 2,625,973 | A | | 1/1953 | Weldon et al. | |
| 2,639,819 | A | | 5/1953 | Marks | |
| 2,664,131 | A | | 12/1953 | Miller | |
| 2,710,084 | A | | 6/1955 | Braverman | |
| 2,721,099 | A | | 10/1955 | Rupp | |
| 2,724,537 | A | | 11/1955 | Fehr | |
| 2,746,582 | A | | 5/1956 | Cart | |
| 2,767,757 | A | | 10/1956 | Marder | |
| 2,778,560 | A | | 1/1957 | Pfeiffer | |
| 2,780,402 | A | | 2/1957 | Zucker et al. | |
| 2,833,460 | A | | 5/1958 | Votolato | |
| 2,879,553 | A | | 3/1959 | Keating | |
| 2,958,357 | A | | 11/1960 | Vorgan | |
| 3,014,516 | A | | 12/1961 | Mueller | |
| 3,017,117 | A | | 1/1962 | Klinger | |
| 3,061,396 | A | | 10/1962 | Hock | |
| 3,126,933 | A | | 3/1964 | Mason et al. | |
| 3,160,307 | A | | 12/1964 | Morrison | |
| 3,233,644 | A | | 2/1966 | Bono | |
| 3,257,077 | A | | 6/1966 | Corning | |
| 3,260,396 | A | | 7/1966 | Buch | |
| 3,265,284 | A | | 8/1966 | Tompkins | |
| 3,310,089 | A | | 3/1967 | Silverman | |
| 3,354,924 | A | | 11/1967 | Birrell et al. | |
| 3,373,925 | A | | 3/1968 | Gatward | |
| 3,410,328 | A | | 11/1968 | Sasai | |
| D213,131 | S | | 1/1969 | Hamilton | |
| 3,439,865 | A | | 4/1969 | Port et al. | |
| D215,846 | S | | 11/1969 | Curtin et al. | |
| 3,480,059 | A | | 11/1969 | Schoening | |
| 3,502,091 | A | | 3/1970 | Corbin | |
| 3,583,748 | A | | 6/1971 | Arndt | |
| 3,603,367 | A | | 9/1971 | Lehrman | |
| 3,661,326 | A | | 5/1972 | Wilson | |
| 3,675,667 | A | | 7/1972 | Miller | |
| 3,675,981 | A | | 7/1972 | Mallander | |
| 3,696,850 | A | | 10/1972 | Rosenblum | |
| 3,709,237 | A | | 1/1973 | Smith | |
| 3,727,786 | A | | 4/1973 | Fausel | |
| 3,732,978 | A | | 5/1973 | Reader | |
| 3,733,758 | A | | 5/1973 | Maier et al. | |
| 3,796,342 | A | | 3/1974 | Sanders et al. | |
| 3,799,384 | A | | 3/1974 | Hurkamp | |
| 3,807,421 | A | | 4/1974 | Geiger et al. | |
| 3,834,528 | A | | 9/1974 | Pickford et al. | |
| 3,843,222 | A | | 10/1974 | Berkun | |
| 3,868,155 | A | | 2/1975 | Cherubini | |
| 3,880,459 | A | | 4/1975 | Kelley | |
| 3,883,026 | A | | 5/1975 | Selz | |
| 3,893,649 | A | | 7/1975 | Cornell et al. | |
| 3,935,958 | A | | 2/1976 | Frangos | |
| 3,946,903 | A | | 3/1976 | Parker | |
| 3,955,706 | A | | 5/1976 | Whitaker | |
| 3,960,161 | A | | 6/1976 | Norman | |
| 3,987,580 | A | | 10/1976 | Ausnit | |
| 3,990,463 | A | | 11/1976 | Norman | |
| 4,010,784 | A | | 3/1977 | Nattrass et al. | |
| 4,011,611 | A | * | 3/1977 | Lederman | 5/655.4 |
| 4,055,239 | A | | 10/1977 | Weiner | |
| 4,073,105 | A | | 2/1978 | Daugherty | |
| 4,094,639 | A | | 6/1978 | McMillan | |
| 4,118,089 | A | | 10/1978 | Johnson et al. | |
| 4,133,149 | A | | 1/1979 | Angress | |
| 4,134,225 | A | | 1/1979 | Welch | |
| 4,165,757 | A | | 8/1979 | Marks | |
| 4,170,082 | A | | 10/1979 | Freedman | |
| 4,180,113 | A | | 12/1979 | Liebling | |
| 4,195,804 | A | | 4/1980 | Hujsak et al. | |
| 4,212,130 | A | | 7/1980 | Walker | |
| 4,246,945 | A | | 1/1981 | Sterling | |
| 4,248,278 | A | | 2/1981 | Blodgett | |
| 4,248,442 | A | | 2/1981 | Barrett | |
| 4,265,261 | A | | 5/1981 | Barker | |
| 4,287,701 | A | | 9/1981 | Washington | |
| 4,299,365 | A | | 11/1981 | Battle | |
| 4,313,634 | A | | 2/1982 | Williams | |
| 4,352,457 | A | | 10/1982 | Weick | |
| 4,388,739 | A | * | 6/1983 | Martinon et al. | 8/150 |
| 4,401,213 | A | | 8/1983 | Lerner | |
| 4,411,300 | A | | 10/1983 | Rico | |
| 4,427,110 | A | | 1/1984 | Shaw, Jr. | |
| D274,662 | S | | 7/1984 | Fausel | |
| 4,485,855 | A | | 12/1984 | Dillingham | |
| D279,249 | S | | 6/1985 | Fausel | |
| 4,580,776 | A | | 4/1986 | Burkinshaw | |
| 4,585,283 | A | | 4/1986 | Redmon et al. | |
| 4,603,432 | A | | 7/1986 | Marino | |
| 4,610,394 | A | | 9/1986 | Bryson | |
| 4,630,312 | A | | 12/1986 | Milstein | |
| 4,630,747 | A | | 12/1986 | Chiang et al. | |
| 4,632,138 | A | | 12/1986 | Irwin | |
| D288,019 | S | | 1/1987 | Gebhard et al. | |
| 4,635,411 | A | | 1/1987 | Kurzen | |
| 4,642,934 | A | | 2/1987 | Carlson et al. | |
| 4,646,802 | A | | 3/1987 | Basore et al. | |
| D290,538 | S | | 6/1987 | Basore | |
| 4,683,927 | A | | 8/1987 | Pyzer | |
| 4,697,357 | A | | 10/1987 | Van Vliet | |
| 4,706,845 | A | | 11/1987 | Schnurer et al. | |
| 4,715,572 | A | | 12/1987 | Robbins, III et al. | |
| 4,716,918 | A | | 1/1988 | Hayashida et al. | |
| 4,728,066 | A | | 3/1988 | Lang et al. | |
| 4,730,748 | A | | 3/1988 | Bane | |
| 4,738,478 | A | | 4/1988 | Bean, Jr. | |
| 4,747,701 | A | | 5/1988 | Perkins | |
| 4,759,518 | A | | 7/1988 | Yardas | |
| 4,779,794 | A | | 10/1988 | Moore | |
| 4,781,300 | A | | 11/1988 | Long | |
| 4,783,031 | A | | 11/1988 | Ebentheuer | |
| 4,784,248 | A | | 11/1988 | Workman | |
| 4,790,029 | A | | 12/1988 | LaFleur et al. | |
| 4,813,520 | A | | 3/1989 | Lin | |
| 4,815,784 | A | | 3/1989 | Zheng | |
| 4,825,892 | A | | 5/1989 | Norman | |
| 4,854,501 | A | | 8/1989 | Ricci | |
| 4,858,634 | A | | 8/1989 | McLese | |

4,862,602 A 9/1989 Krill
4,876,829 A 10/1989 Mattick
4,895,230 A 1/1990 King
4,899,967 A 2/1990 Johnson
4,903,584 A 2/1990 Styles
4,925,102 A 5/1990 Jones et al.
4,940,200 A 7/1990 Sawyer et al.
4,946,118 A 8/1990 Hastings
4,948,077 A 8/1990 Gonzalez
4,951,333 A 8/1990 Kaiser et al.
4,953,815 A 9/1990 Beymer et al.
4,964,859 A 10/1990 Feldman
4,989,749 A 2/1991 Choi
4,995,487 A 2/1991 Plath
D315,432 S 3/1991 Smith
5,009,189 A 4/1991 Neff
5,022,767 A 6/1991 Cardulla
5,024,262 A 6/1991 Huang
5,027,748 A 7/1991 Wolak
5,031,793 A 7/1991 Chen et al.
5,035,460 A 7/1991 Huang
5,036,999 A 8/1991 Bitsch
5,038,812 A 8/1991 Norman
5,054,507 A 10/1991 Sparks
5,072,828 A 12/1991 Irvine
5,082,219 A 1/1992 Blair
5,090,588 A 2/1992 Van Romer et al.
RE33,842 E 3/1992 Ebentheuer
5,116,138 A 5/1992 Macsenti et al.
5,118,201 A 6/1992 Cook
5,134,815 A 8/1992 Pickett
5,137,044 A 8/1992 Brady
5,143,283 A 9/1992 Lancaster
5,174,462 A 12/1992 Hames
5,195,649 A 3/1993 Wolters
5,213,147 A 5/1993 Zheng
5,222,513 A 6/1993 Hilliard
5,253,775 A 10/1993 Gould
5,263,672 A 11/1993 He
5,273,142 A 12/1993 Weber
5,301,705 A 4/1994 Zheng
5,324,490 A 6/1994 Van Vlahakis et al.
5,335,805 A 8/1994 Chen
5,356,024 A 10/1994 Ho et al.
5,358,440 A 10/1994 Zheng
5,375,267 A 12/1994 Davis
5,382,087 A 1/1995 Pouch
5,393,023 A 2/1995 Callan
5,394,897 A 3/1995 Ritchey et al.
5,411,046 A 5/1995 Wan
5,429,437 A 7/1995 Shaw et al.
5,437,384 A 8/1995 Farrell
5,437,410 A 8/1995 Babasade
5,464,113 A 11/1995 Ho et al.
5,467,794 A * 11/1995 Zheng ..... 135/125
5,468,061 A 11/1995 Friess et al.
5,474,196 A 12/1995 Fausel et al.
5,492,675 A 2/1996 Brizard
5,560,385 A 10/1996 Zheng
5,576,621 A 11/1996 Clements
5,593,046 A 1/1997 Katsuura et al.
5,664,596 A 9/1997 Zheng
5,664,886 A 9/1997 Hutchinson
5,671,479 A 9/1997 Dedrick
5,722,446 A 3/1998 Zheng
5,746,514 A 5/1998 Orensten
5,762,530 A 6/1998 Zheng
5,778,915 A 7/1998 Zheng
5,800,067 A 9/1998 Easter
5,816,279 A 10/1998 Zheng
5,816,954 A 10/1998 Zheng
5,827,104 A 10/1998 Zheng
5,845,697 A 12/1998 Zheng
5,853,313 A 12/1998 Zheng
D406,423 S * 3/1999 Kellogg et al. ..... D32/37
D407,765 S 4/1999 Zheng
5,901,926 A 5/1999 Zheng
5,910,038 A 6/1999 Zheng
5,910,058 A 6/1999 Zheng
5,927,793 A 7/1999 McGrath, Jr.
5,938,496 A 8/1999 Zheng
5,941,265 A 8/1999 Zheng
5,964,533 A 10/1999 Ziglar
5,967,357 A 10/1999 Kellogg et al.
5,971,188 A 10/1999 Kellogg et al.
5,975,101 A 11/1999 Zheng
5,992,045 A 11/1999 Kellogg et al.
5,992,676 A 11/1999 Tsai
6,006,772 A 12/1999 Zheng
6,059,912 A 5/2000 Kellogg et al.
D431,361 S 10/2000 Kellogg et al.
D433,810 S 11/2000 Kellogg et al.
D438,009 S 2/2001 Kellogg et al.
6,220,998 B1 4/2001 Kellogg et al.
6,390,111 B2 5/2002 Zheng
6,502,595 B2 * 1/2003 Louie ..... 135/125

* cited by examiner

Fig. 22a
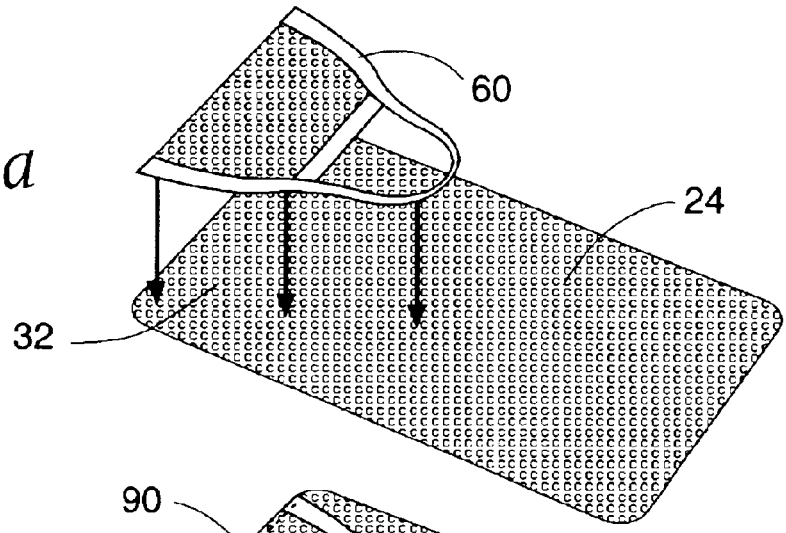
Fig. 22b
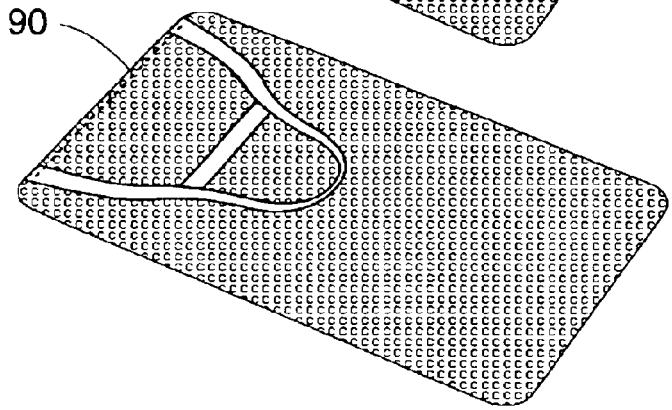
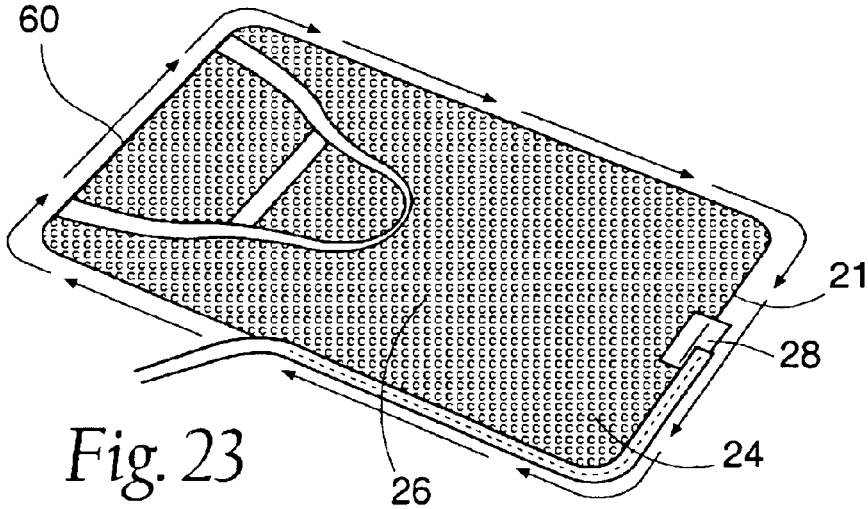
Fig. 23

Fig. 24a
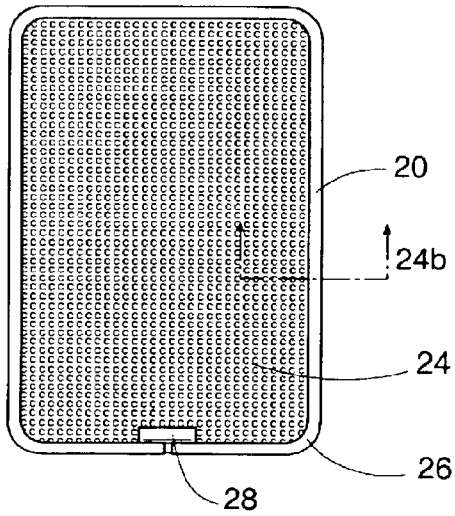
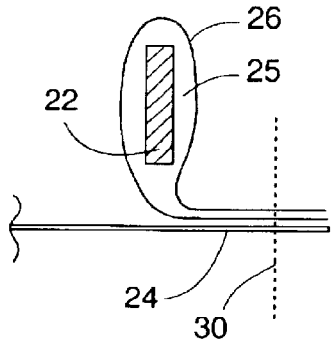
Fig. 24b
Fig. 25
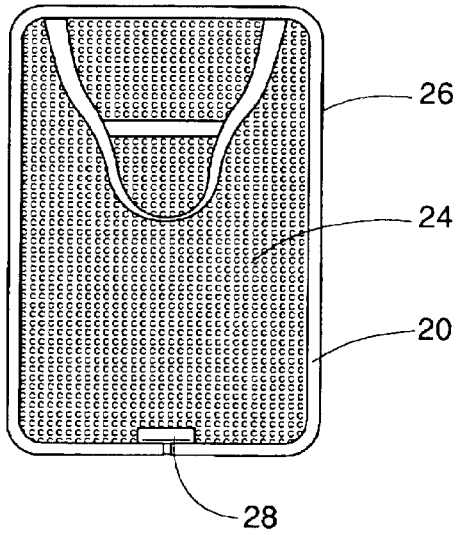

COLLAPSIBLE STRUCTURE

This is a continuation-in-part patent application of U.S. patent application Ser. No. 09/834,437 filed Apr. 13, 2001 now pending and now abandoned, which is a continuation-in-part of U.S. patent application Ser. No. 09/698,674 filed on Oct. 27, 2000 that has since issued to U.S. Pat. No. 6,494,335, which is a continuation-in-part of U.S. patent application Ser. No. 09/393,956 filed on Sep. 10, 1999 now abandoned, which is a continuation-in-part of U.S. parent application Ser. No. 09/108,521 filed on Jul. 1, 1998 that has since issued to U.S. Pat. No. 5,971,188, now RE37,924 issued Dec. 10, 2002; the pending application and the issued patents are commonly owned by the assignee hereof. The present invention relates generally to collapsible structures and specifically to a collapsible container for convenient storage and transportation of items.

BACKGROUND OF THE INVENTION

The present invention has numerous applications including container, play structure, and shelter. A typical household often encounters the need for temporary storage of garments prior to washing or cleaning. Regardless of the place where laundry or cleaning is done, either at home or in a commercial setting, soiled garments need to be sorted, stored, and eventually transported to a designated place. The present invention can be utilized for garment sorting, storage and transportation. The present invention can also be utilized as an organizer for various objects. For example, the present invention may be used to organize objects normally found in the trunk of a car. Alternatively, the present invention can also be used for other purposes, such as the storage or transportation of toys or other objects. Further yet, the present invention could be used as a child's play structure or pet den structure. Accordingly, its use is multipurpose as both a container and structure.

Numerous devices are known in the art to provide effective storage of soiled garments, for example laundry baskets, conventional hampers, or clothing bags. For example, U.S. Pat. No. 2,625,973 to Weldon et al. teaches a laundry hamper comprising a rectangular frame having upper and lower portions that telescope within one another in a detachable manner. The lower portion includes a base frame, while the upper portion comprises a top frame. A cover is secured by a hinge to the top frame and an outer bag surrounds the rectangular frame. A plurality of small inner bags are provided within the outer bag. U.S. Pat. No. 1,581,888 to Thomas discloses a collapsible receptacle comprising two rectangular wire frames, hingedly secured together, means for holding the frames to form a triangularly shaped structure, and a fabric portion covering the frames and providing an enclosure.

However, all these prior art devices are voluminous in their expanded state, are uneasy to fold or collapse, are still relatively voluminous in their collapsed state, and are difficult to manipulate. The present invention solves the above-mentioned shortcomings and provides a convenient, easy to manipulate, and ergonomic means for storing or transporting garments or other objects.

Other devices are known in the art to be collapsible structures. For example, U.S. Pat. No. 5,560,385 to Zheng teaches a collapsible play structure. This device forms a large cubicle that children can crawl through. However, each cube of the Zheng device utilizes three (3) frame members, preferably four members, to achieve structural integrity. The present invention may be practiced with as few as two frame members.

SUMMARY OF THE INVENTION

The present invention relates generally to a collapsible structure and specifically to a collapsible structure for storing articles or forming a child's toy and method of making and using the same.

According to the present invention, the foregoing and other advantages are obtained by providing a collapsible structure comprising a plurality of side panels and a floor panel forming an enclosure having an open top. In the preferred embodiment, each side panel comprises a flexible continuous loop frame, a web of material, and an edging material. The edging envelops the frame and is coupled to the periphery of the web. The floor panel is attached to the bottom side of each side panel thus forming the structure.

In an alternative embodiment, each side panel is attached to a side panel separator, which in turn is connected to the next adjacent side panel. The floor panel is attached to both the bottom side of each side panel and to the side panel separators, thus providing means for holding articles within the structure and for supporting the structure in its expanded state.

In another alternative embodiment, a single frame member forms the frame structure for two side panels. Each side panel comprises a web of material and an edging material. The edging material is attached to portions of the web. The edging partially envelops the frame and is coupled to predetermined portions of the periphery of the web. The floor panel is attached to the bottom side of each side panel, thus forming the structure.

In accordance with an aspect of the invention, at least one handle member is coupled to opposite side panels at the open top of the structure. Alternatively, the handle may be coupled to only one side panel or may be an aperture formed within one or more of the side panels. In yet another variation, the edging may be attached to portions of the frame and the handle may be coupled to or looped around the frame at a portion not including edging.

In accordance with another aspect of the invention, an optional storage pouch may be coupled to one of the side panels at the open top of the structure. The present invention is easily collapsed into a compact state and the pouch allows storage of the structure in its collapsed, compact state.

In another alternative embodiment, the collapsible structure further comprises a divider panel, the divided panel being attached to diagonally opposite edgings of the side panels. In yet another alternative embodiment, the collapsible structure further comprises at least two divider panels, preferably arranged substantially parallel to each other and being coupled to opposite side panels to create at least three separate compartments within the structure.

In yet another embodiment, each side panel comprises a flexible, continuous loop frame, and a two-ply web of material. The loop frame is captured between the two layers of web material comprising the two-ply web. The floor panel is attached to the bottom side of each side panel, thus forming the structure. Similarly to previously mentioned embodiments, at least one handle member may be coupled to opposite side panels at the open top of the structure. Alternatively, the handle may be coupled to only one side panel or may be an aperture formed within one or more of the side panels. Further, and as discussed in conjunction with previously mentioned embodiments, the two-ply embodiment may further include an optional storage pouch for receiving the structure in the collapsed state for storage.

A preferred method of manufacturing the collapsible structure includes the steps of attaching each handle member to a side of two opposite webs. The edging is next coupled to each web such that the edging surrounds the perimeter of the web and forms a channel or pocket through which the frame will later be inserted. After the requisite number of side panels has been formed, each side of the floor panel is attached to the bottom side of each side panel. Next, a side of each side panel is connected with a side of an adjacent side panel. The frame for each side panel is inserted through the channel formed by each edging. The ends of each frame member are connected, preferably using a crimped butt connector, to give the collapsible structure its ability to freely stand in a rigid, expanded, upright state. optionally, the edging may be non-continuous to allow the handle members to be attached to or looped around the frame member at a non-continuous gap in the edging.

An alternative method of manufacturing the collapsible structure includes the steps of supplying two attached webs of material. Next, edging is coupled to each web such that the edging substantially surrounds the perimeter of each web and forms a channel or pocket through which the frame will later be inserted. An opening in the edging is left along the respective sides where the two webs are contiguous. A two-web side panel is thus formed. After a pair of two-web side panels have been formed, a single frame is inserted through the channel formed by the edging of each two-web side panel. Each frame first is threaded through the edging surrounding one web and then is threaded through the edging surrounding the second, contiguous web. The ends of each frame member are connected, preferably using a crimped butt connector, in a "figure eight" configuration to give the collapsible structure its ability to freely stand in a rigid, expanded, upright state. The second two-web side panel is completed by the same steps. The pair of two-web side panels are connected together and a floor panel is attached along the lower edge of each side panel.

Yet another alternative method of manufacturing the collapsible structure includes the steps of attaching each handle member to a side of two opposite webs. Coupling the edging to each web such that the edging surrounds the perimeter of the web and forms a channel or pocket through which the frame will later be inserted. After the requisite number of side panels has been formed, each corner of the floor panel is attached to one end of each side panel separator. Next each side panel is connected with one side of the floor panel and with two adjacent side panel separators. The frame for each side panel is inserted through the channel formed by each edging. The ends of each frame member are connected, preferably using a crimped butt connector, to give the collapsible structure its ability to freely stand in a rigid, expanded, upright state. Optionally, the edging may be non-continuous to allow the handle members to be attached to or looped around the frame at a non-continuous gap in the edging.

Yet another alternative method of manufacturing the collapsible structure includes the step of first joining two webs together leaving a small opening for receiving the continuous loop frame member. This forms a side panel. The requisite number of side panels are formed and attached along their side edges. Next, each side of a floor panel is attached to the bottom side of each side panel. The frame for each side panel is inserted through the small opening. Finally the opening is closed. Optionally, one or more handles may be attached to or formed in the side panel, frame or both.

In the alternative embodiment where the first web is continuous and non-interrupted and the second web has an annular configuration, the first step comprises attaching the first web to the second web along their outer peripheries to form a side panel. Next, the requisite number of side panels are formed and attached along their side edges. Next each side of a floor panel is attached to the bottom side of each side panel. The frame for each side panel is inserted into the peripheral opening formed between the first and second webs. Again optionally, one or more handles may be attached to or formed in the side panel, frame or both.

From the expanded state, the structure can be folded and collapsed for storage or transportation. The preferred steps of collapsing the structure include grasping opposite corners of the floor panel and biasing one corner toward the other until all side panels are adjacent and overlay each other. The structure is now partially collapsed but each side panel is still in an expanded state. Next, the optional handle members and the floor panel are inserted in between any two of the adjacent overlaying side panels. By rotating two opposite corners of the flattened, overlaying side panels in opposite directions while biasing the two corners toward each other, the structure will form three overlaying circular loops folded adjacently. Finally, the three overlaying loops may be placed into an optional storage pouch. The pouch prevents the structure from springing back into its fully expanded condition. Alternatively, the three overlaying loops may be maintained in the collapsed state by way of an elastic band or other retaining device.

DESCRIPTION OF THE DRAWINGS

FIGS. 22A through 30 depict the preferred method of manufacturing the collapsible structure.

DETAILED DESCRIPTION

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

The present invention, a collapsible structure 10, is illustrated in FIGS. 1 through 4.

Figure 4:
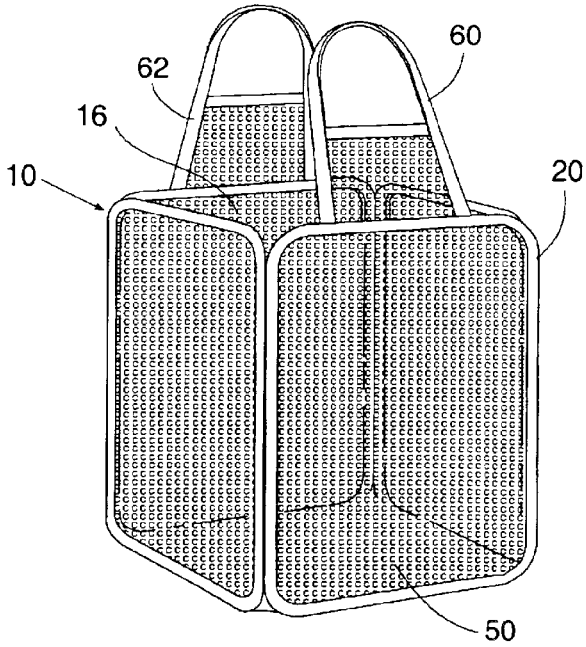
FIG. 4 is a perspective view of the collapsible structure.
Figure 5:
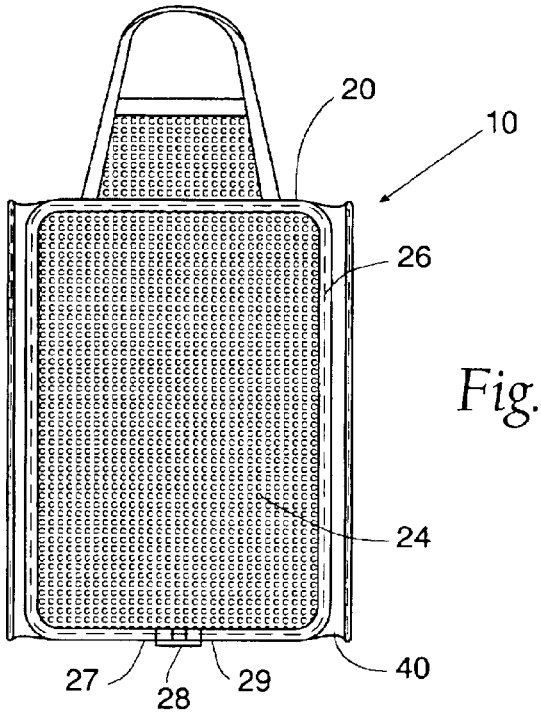
FIG. 5 is a front plan view of the preferred embodiment of the collapsible structure.

As shown in FIG. 4, the structure 10 comprises four rectangular side panels 20, a floor panel 50, and two handles 60 and 62. The side and floor panels 20 and 50 are connected to one another to form a substantially rectangular structure having an open top 16.

Figure 1:
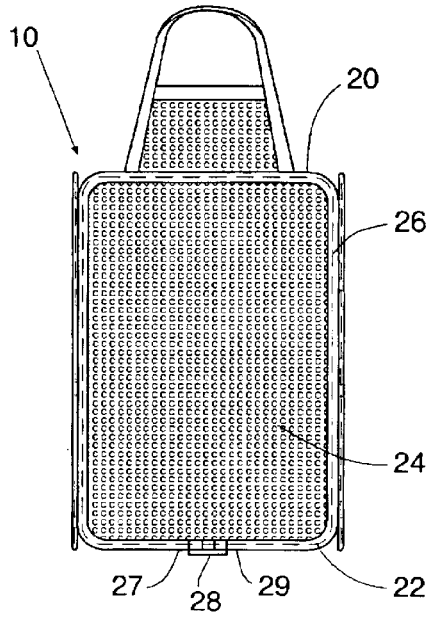
FIG. 1 is a front plan view of the collapsible structure.
Figure 2:
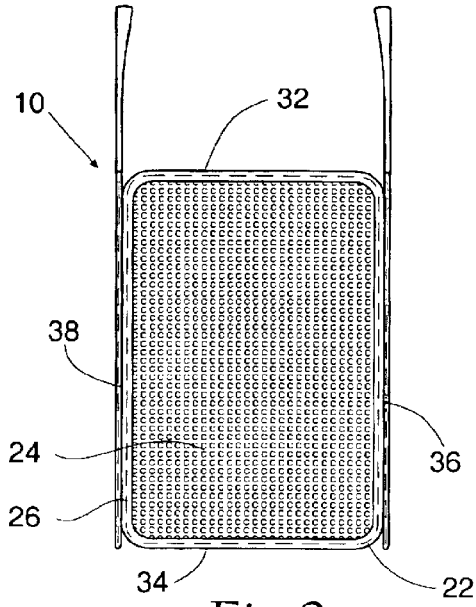
FIG. 2 is a side plan view of the collapsible structure.

Referring to FIGS. 1 and 2, each side panel 20 further comprises a frame 22, a web 24, and an edging 26. The frame 22 is flexible, preferably formed from a sufficiently stiff yet resilient material such as spring steel wire or plastic, and is contained within the channel or pocket 25 formed by the edging 26 (best seen in FIGS. 6*b* and 24*b*). The frame 22 forms a continuous loop. Preferably, the frame 22 has a rectangular cross-section, but a material with a different geometric cross-section can be used. The web 24 is a flexible foldable material, such as nylon cloth or nylon mesh, but can be any suitably flexible material. The nylon, or other flexible material, may be solid or perforated. The perimeter of the web 24 is stitched to the edging 26 such that the edging 26 forms a pocket 25 about the periphery of the web 24. The edging 26 is a foldable, but stretch-resistant material capable of housing the frame 22 within its pocket 25. The edging 26 has two ends 27 and 29.

A seam cover 28, also made out of a foldable stretch-resistant material, may be provided to cover the ends 27 and 29 of the edging 26, thereby protecting the frame 22 from escaping out of the edging 26. As shown in FIG. 1, the seam cover 28 is also stitched to the web 24.

Figure 3:
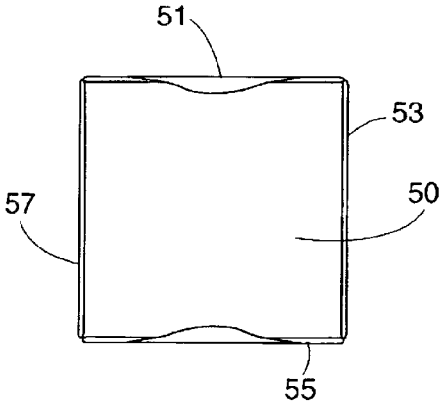
FIG. 3 is a top plan view of the collapsible structure.

As shown in FIG. 3, the floor panel 50 is also a foldable web of material and has a generally rectangular shape. The floor panel 50 has four corner sections 52, 54, 56, 58 and is attached to four substantially perpendicular sides 51, 53, 55, 57 of each side panel 20. The floor panel 50 provides means for holding the garments or other objects (not shown) within the structure 10 and for supporting the structure 10 in its expanded state.

Referring now to FIGS. 5–8, one embodiment of the collapsible structure 10 is shown. This embodiment includes side panel separators 40 located between each side panel 20. However, it should be noted that the side panel separators 40 are not required to practice the present invention. The side panel separators 40 are shown to be substantially longitudinal, each including an end 42 attached preferably by means of stitching to one of the corner sections 52, 54, 56, 58 of the floor panel 50. The other end 44 of each separator 40 corresponds to the open top 16 of the structure 10. The side panel separators 40 are preferably formed from a stretch-resistant material similar to the material used for the seam covers 28 or the edging 26.

Figure 6A:
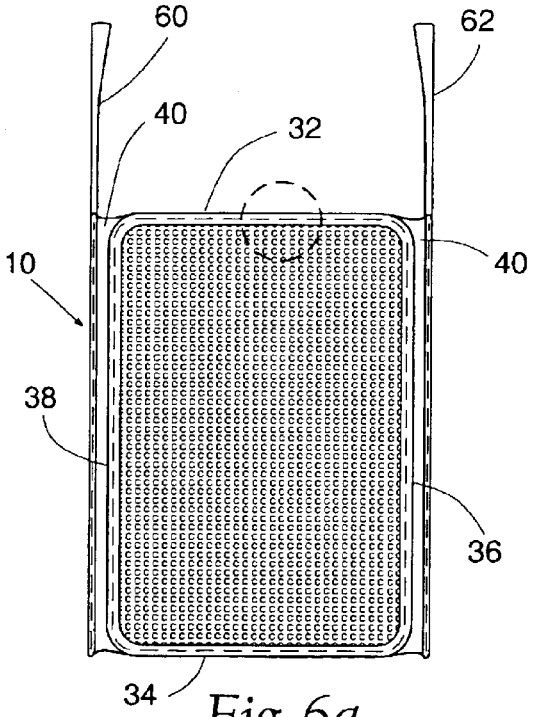
FIG. 6A is a side plan view of the collapsible structure.

As shown in FIG. 6A, each rectangularly-shaped side panel 20 includes a top side 32 corresponding to the open top 16 of the structure 10, a floor side 34 attached to one of the sides 51, 53, 55, 57 of the floor panel 50, and two lateral sides 36 and 38. Referring just to FIG. 6A, each lateral side 36 and 38 is attached to a side panel separator 40 adjacent to the side panel 20.

Figure 8:
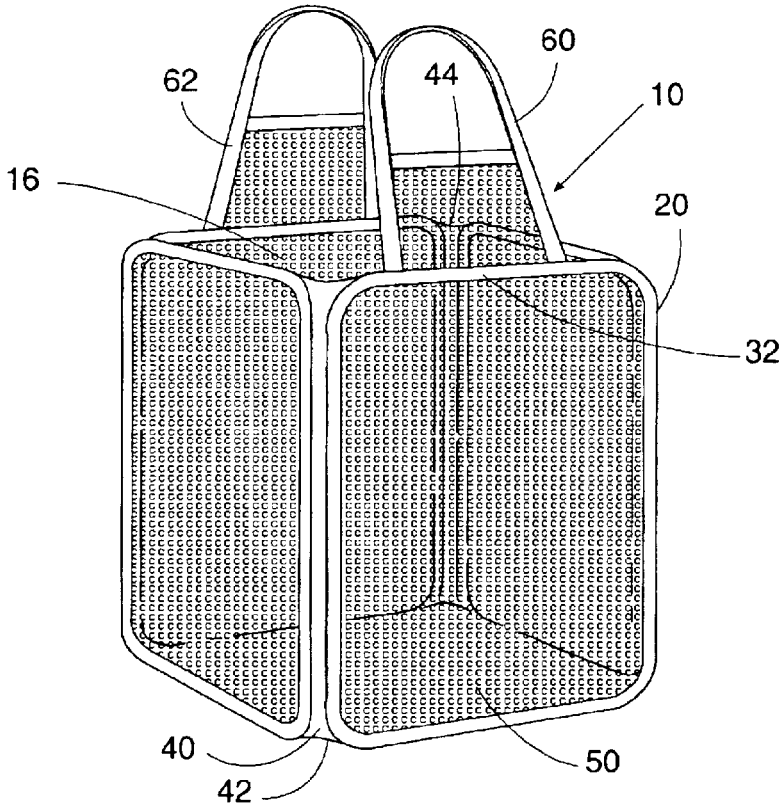
FIG. 8 is a perspective view of the collapsible structure.
Figure 9:
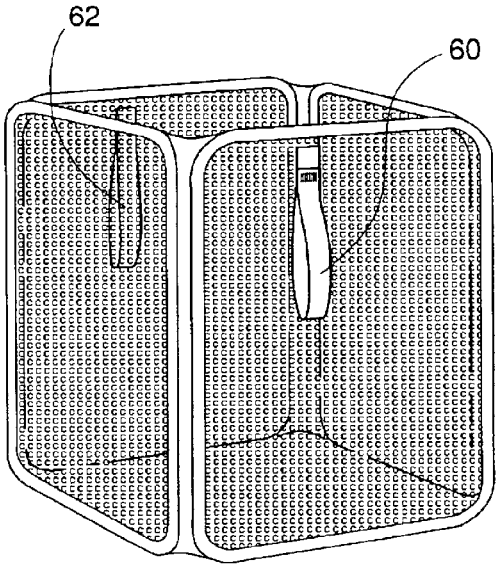
FIGS. 9–12 depict four alternative embodiments of the collapsible structure, namely showing different handle configurations.
Figure 10:
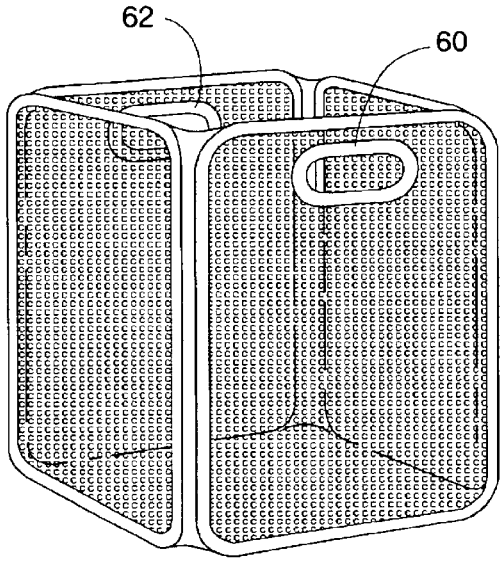
Figure 11:
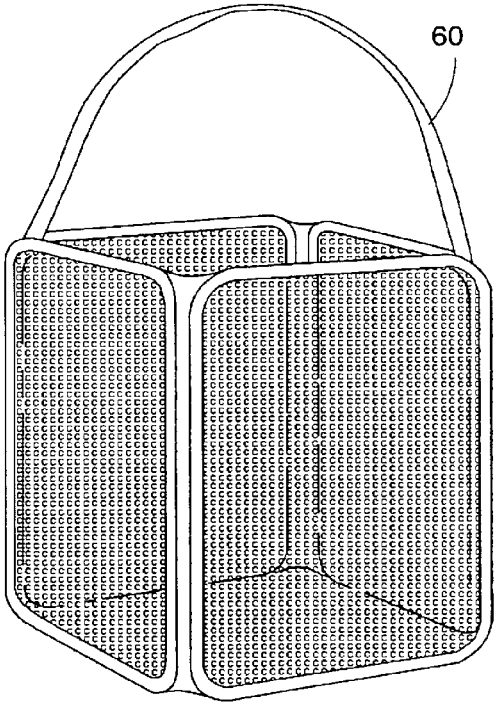
Figure 12:
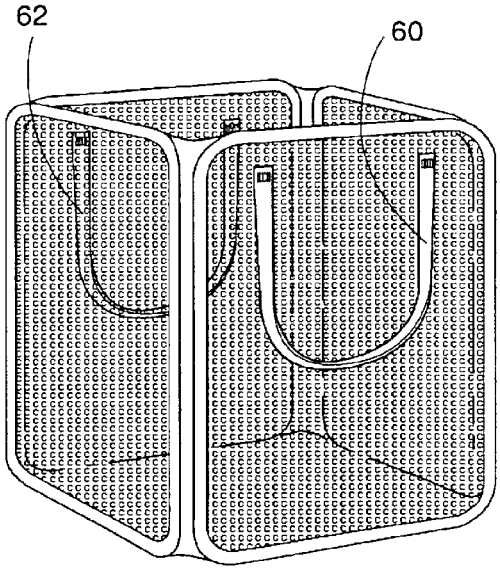

As depicted in FIGS. 4 and 8, the handles 60 and 62 have both ends connected to the top side 32 of two opposing side panels 20. The handles 60 and 62 are formed from a stretch-resistant material having a mesh web that extends between a portion of each strap side. The handles for the present invention are not limited to the particular type shown in FIGS. 4 and 8. Several alternative embodiments are shown in FIGS. 9 through 12, illustrating different handle members. In FIG. 9, the handle members 60 and 62 are straps stitched to opposite side panels. FIG. 10 depicts an alternative embodiment wherein the handle members 60 and 62 are apertures or openings formed in the webs 24 of two opposite side panels 20. In FIG. 11, one handle member 60 is shown as a strap coupled to diagonally opposed side seam separators 40. In FIG. 12, the handles 60 and 62 are preferably stitched directly to the webs 24 of two opposite side panels 20.

Figure 13:
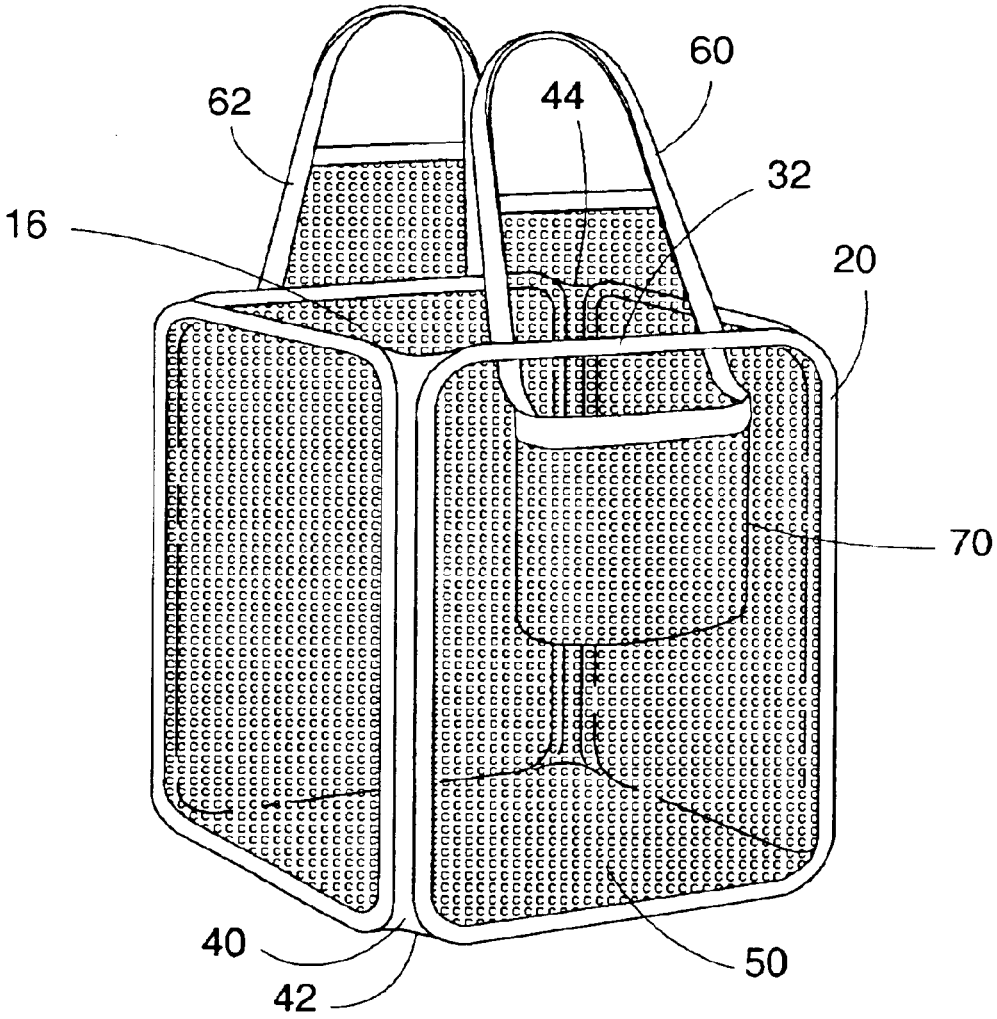
FIG. 13 is a perspective view of the collapsible structure including a storage pouch.
Figure 14:
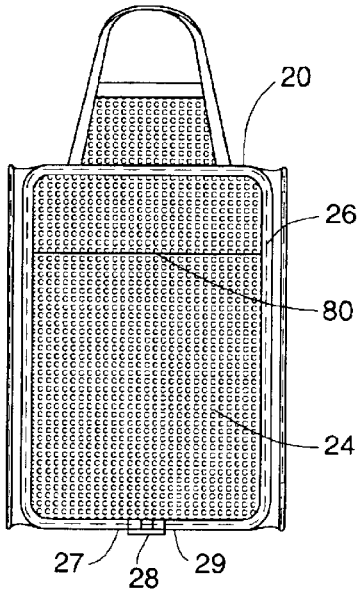
FIG. 14 is a front plan view of a fifth embodiment of the collapsible structure, namely a two-compartment structure.
Figure 15:
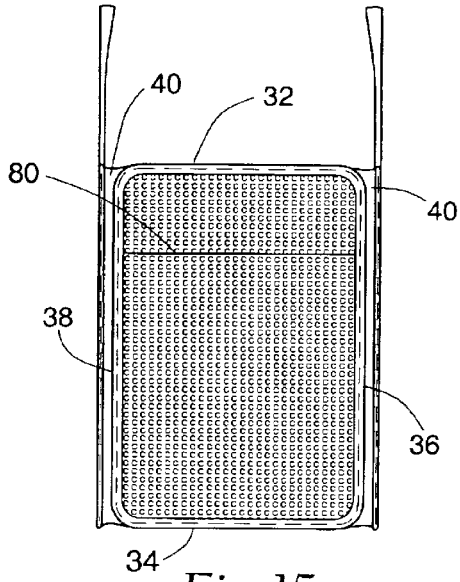
FIG. 15 is a side plan view of a fifth embodiment of the collapsible structure.
Figure 16:
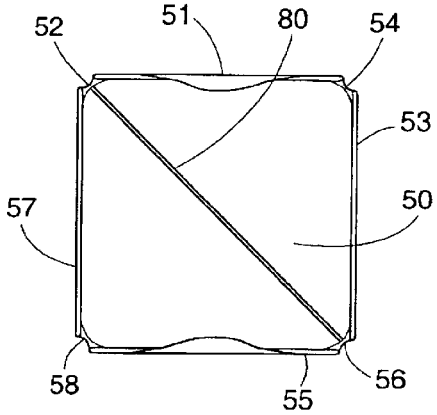
FIG. 16 is a top plan view of a fifth embodiment of the collapsible structure.
Figure 17:
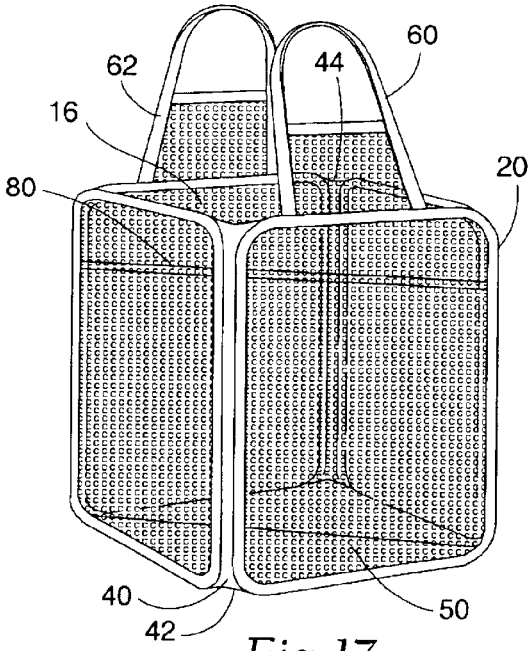
FIG. 17 is a perspective view of a fifth embodiment of the collapsible structure.
Figure 21:
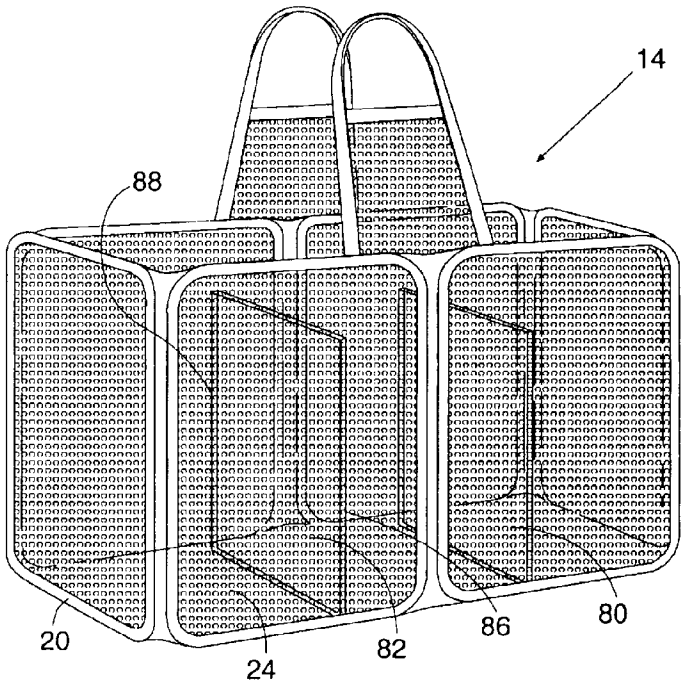
FIG. 21 is a perspective view of a sixth embodiment of the collapsible structure.
Figure 19:
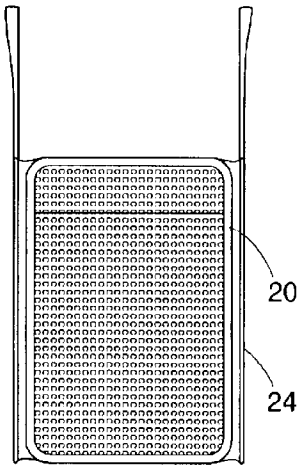
FIG. 19 is a side plan view of a sixth embodiment of a fifth embodiment of the collapsible structure.
Figure 18:
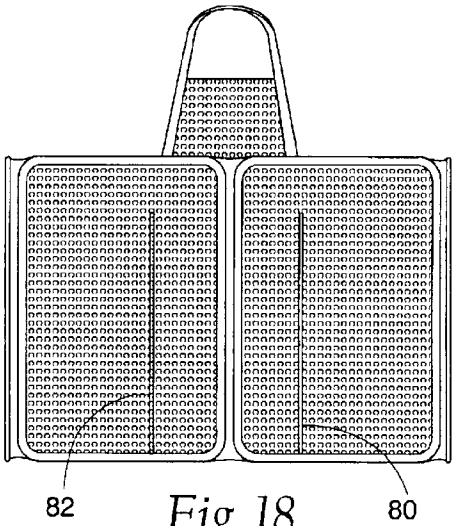
FIG. 18 is a front plan view of a sixth embodiment of the collapsible structure, namely a three-compartment structure.
Figure 20:
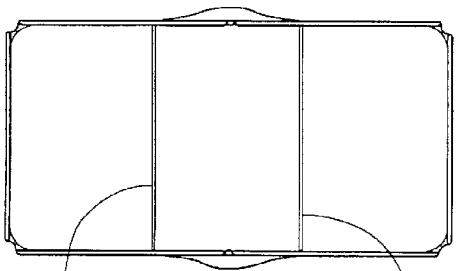
FIG. 20 is a top plan view of a sixth embodiment of the collapsible structure.

As shown in FIG. 13, an optional storage pouch 70 may be formed from a foldable material, such as nylon mesh, and stitched to the side 32 of one of the side panels 20. The storage pouch 70 is dimensioned to accommodate the structure 10 in its collapsed state as later described.

Although stitching is presented as the preferred means for attaching or connecting the elements of the structure 10 and permitting relatively convenient folding of the structure 10, it is to be understood that other methods of attachment can be used in this invention. Such other methods may include heat sealing, gluing and the like. Accordingly, construction of the collapsible structure should not be limited to stitching alone.

FIGS. 14 through 17 depict an alternative embodiment of the collapsible structure 12. The structure 12 further includes a divider panel 80. Divider panel 80 is connected to opposite side seam separators 40 thereby dividing the interior of the structure 12 into two separate chambers.

FIGS. 18 to 21 show a second alternative embodiment of the collapsible structure 14. The structure 14 comprises six side panels 20 and two divider panels 80 and 82. The divider panels 80 and 82 are arranged substantially parallel to one another. Each divider panel 80 and 82 is made out of a foldable material, such as nylon mesh, and has two sides 86 and 88 stitched to webs 24 of two opposite side panels 20. The divider panels 80 and 82 separate the interior of the structure 14 into three separate compartments for improved sorting and storage of objects.

FIGS. 22 to 30 show various stages in the manufacturing process of the preferred embodiment of collapsible structure 10. Referring to FIGS. 22A and 22B, the step of stitching the handle 60 to the top side 32 of two (2) of the webs 24 is shown. Specifically, the stitching is shown at 90.

In FIG. 23, a seam cover 28 is partially stitched to side 21 of each of the four (4) webs 24. In the two (2) webs having handles 60 or 62, the seam cover 28 is placed and sewn opposite to the handle 60 or 62. Each seam cover 28 is preferably placed in the middle of the side 21 and includes a flap or unstitched portion, but it is to be understood that it could be placed anywhere on any side of each of the webs 24. Referring now to FIG. 24B, the edging 26 is then folded in a channel-like fashion around the periphery of the web 24 and stitched to the web 24, surrounding the perimeter of the web 24. The stitching is shown at 30. The stitched edging 26 forms a pocket 25 around the periphery of each web 24. In the preferred embodiment, each structure 10 requires four (4) webs 20. The two (2) sides including the web 24, edging 26 and seam cover 28 are shown in FIG. 24*a* and the two (2) sides including the handle 60, web 24, edging 26 and seam cover 28 are shown in FIG. 25. Stitching of each edging 26 starts and ends at the seam cover 28, thereby leaving a small space between ends 27 and 29 of each edging 26.

Figure 26A:
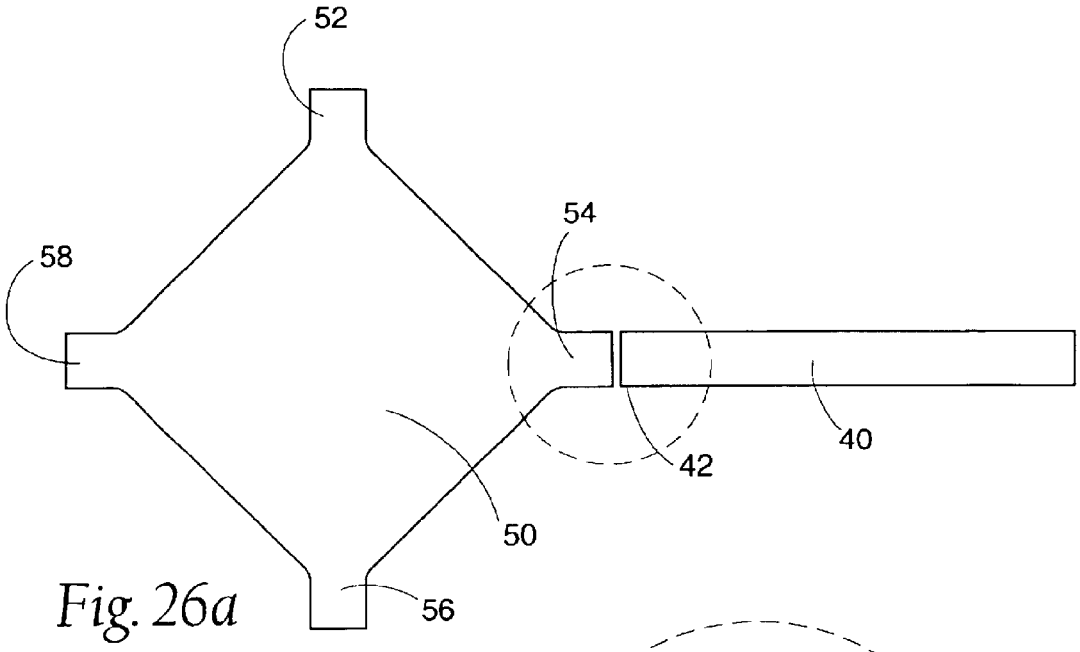
Figure 26B:
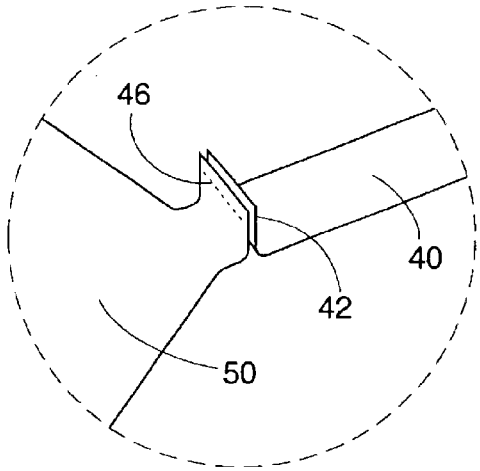
Figure 27:
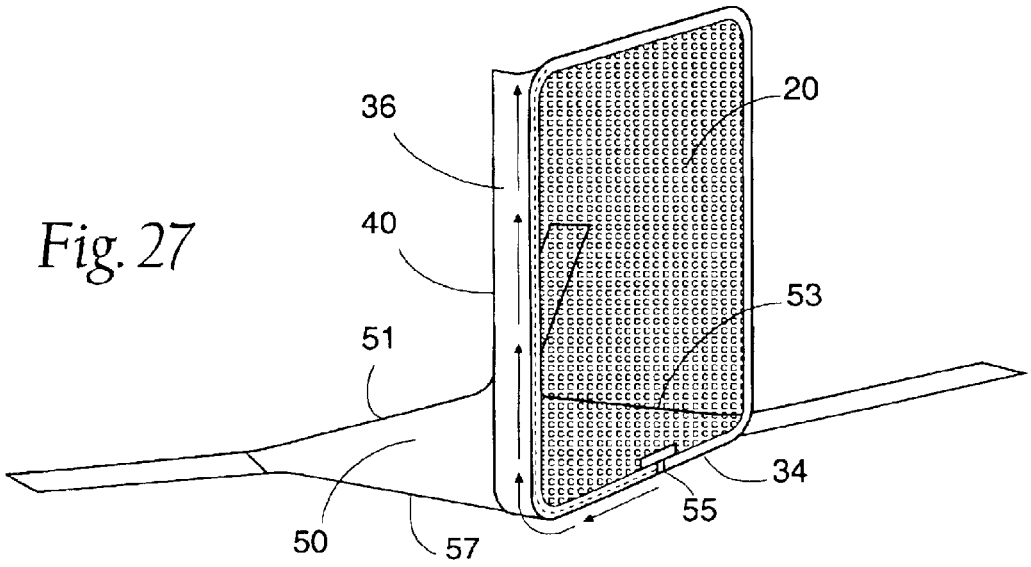
Figure 28:
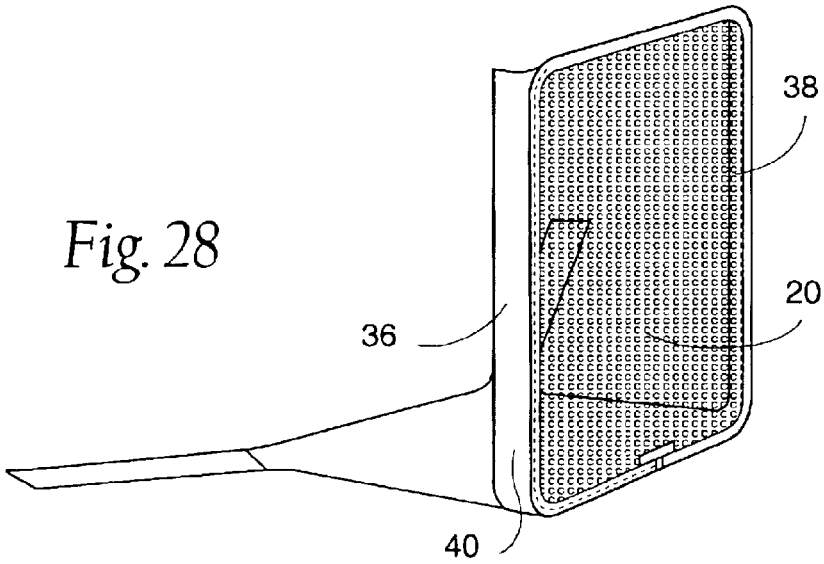
Figure 29:
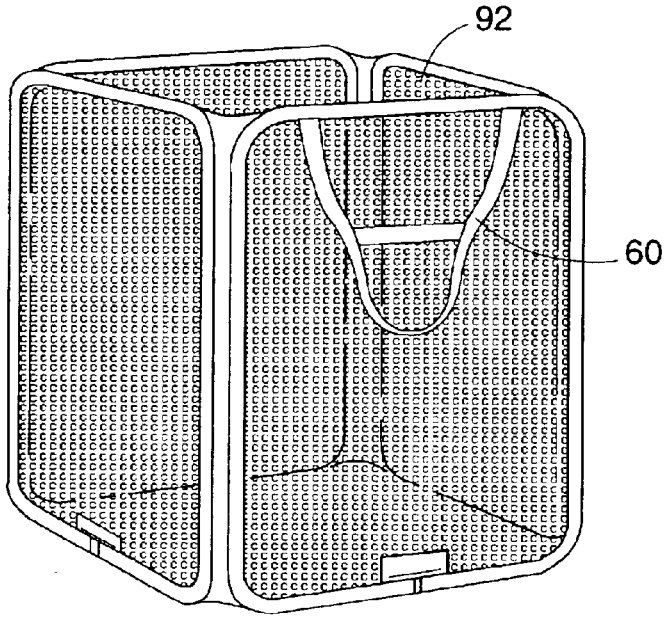

In FIGS. 26A and 26B, the next step involves stitching each corner section 52, 54, 56, 58 of the floor panel 50 to the end 42 of each side panel separator 40. The stitching is shown at 46. Now referring to FIGS. 27 and 28, the step of attaching each of the four side panels 20 by means of stitching to the floor panel 50 and the side panel separators 40 is shown. The two (2) side panels 20 containing the handles 60 and 62 should be positioned opposite each other with the handles 60 and 62 facing inwardly toward each other. First, the floor side 34 of each of the side panels 20 is stitched to one of the sides 51, 53, 55, 57 of the floor panel 50 as shown in FIG. 23. Still referring to FIG. 23, next the lateral sides 36 of each of the side panels 20 is stitched to the corresponding adjacent side panel separator 40. As shown in FIG. 28, once the first lateral side 36 of a side panel separator 40 is stitched on one side, the second lateral side 38 of another side panel separator 40 is stitched to the other side. The resulting enclosure 92 is shown in FIG. 29.

As discussed previously, the structure 10 may be constructed without the side panel separators 40. In constructing the embodiment without side panel separators 40, the two (2) side panels 20 containing the handles 60 and 62 are positioned opposite each other with their handles 60 and 62 facing inwardly toward each other. The floor side 34 of each of the side panels 20 is stitched to one of the sides 51, 53, 55, 57 of the floor panel 50. Next the lateral sides 36, 38 of each of the side panels 20 are stitched to an adjacent side panel 20 thus forming the structure 10 having an open top 16.

Figure 30:
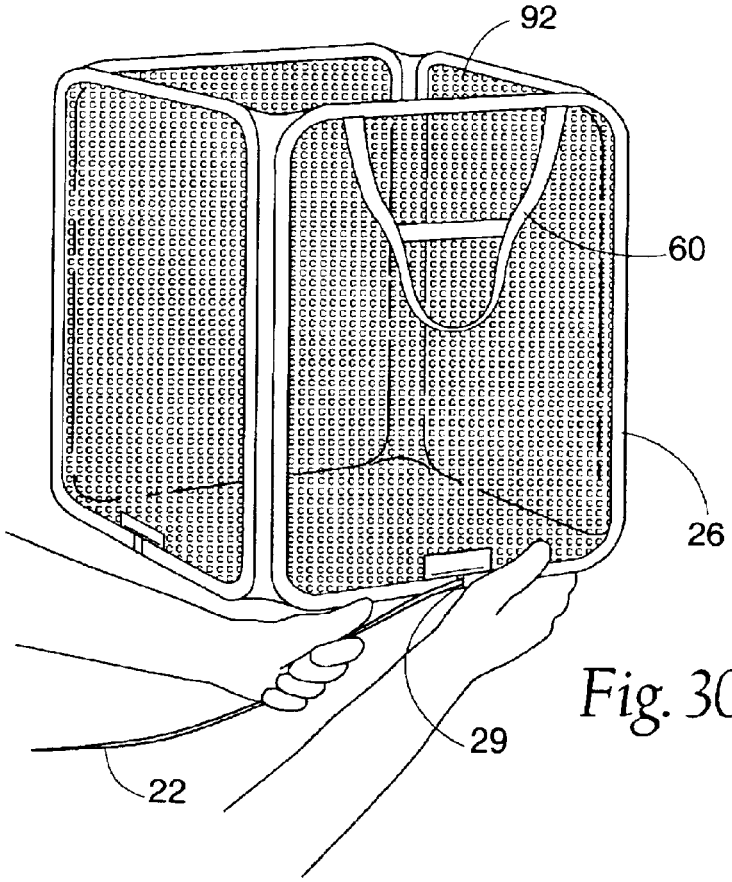

The final steps of the manufacturing process of the present invention involve inserting the frame 22 in one of the open ends 27 or 29 of each of the edgings 26 as shown in FIG. 30. The frame 22 is passed through the edging 26 and around the periphery of each of the side panels 20. The ends of the frame 22 are joined together such that the frame 22 forms a continuous loop. In the preferred embodiment, the frame ends are connected by inserting each end into a butt connector and crimping the connector. Finally, the unstitched portion of each seam cover 28 is stitched to side 21 of each web 24 and over the ends 27 and 29 of each edging 26, thereby protecting the frame 22 from escaping the edgings 26.

Figure 31:
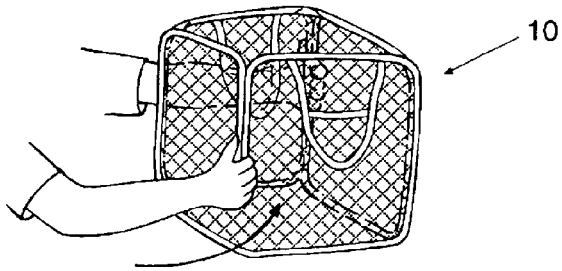
FIGS. 31 through 36 depict the method of collapsing the collapsible structure.
Figure 34:
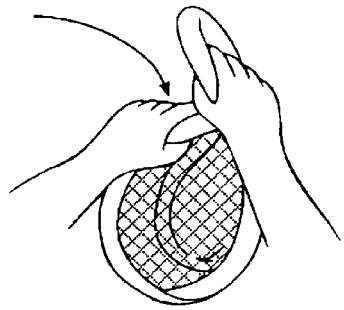
Figure 32:
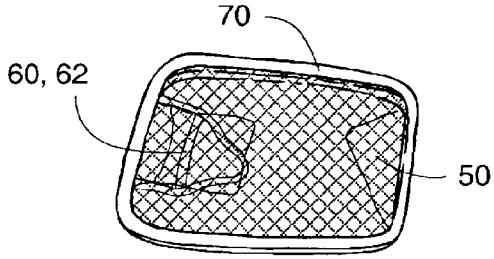
Figure 35:
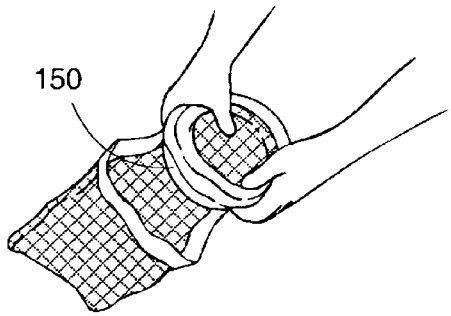
Figure 33:
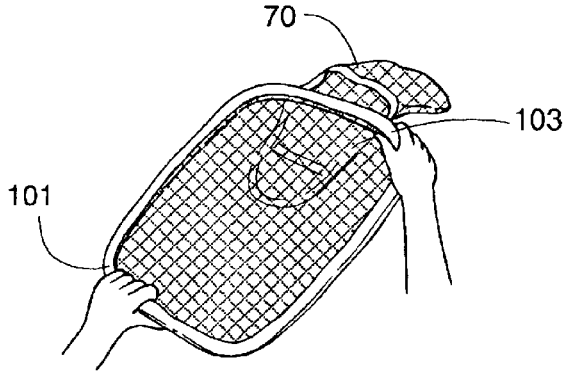
Figure 36:
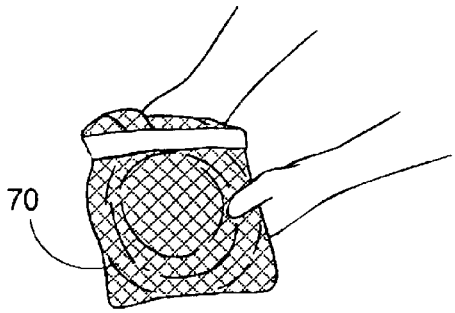
Figure 37:
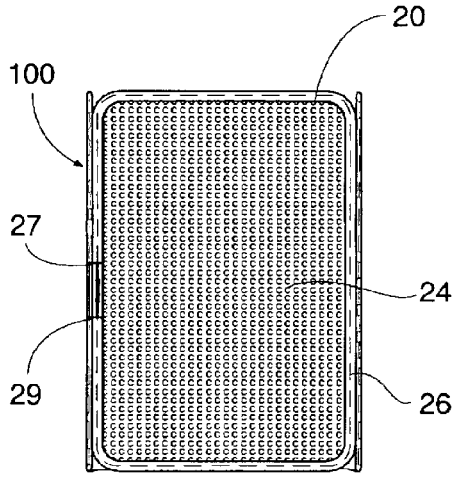
FIGS. 37 is a front plan view of a seventh embodiment of the collapsible structure, namely a structure having two frame members.
Figure 38:
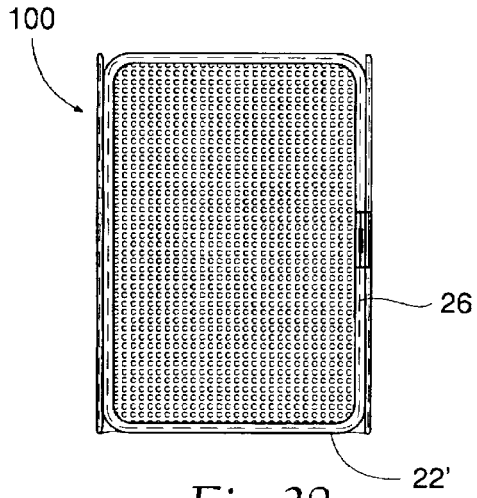
FIG. 38 is a side plan view of the collapsible structure seen in FIG. 37.
Figure 39:
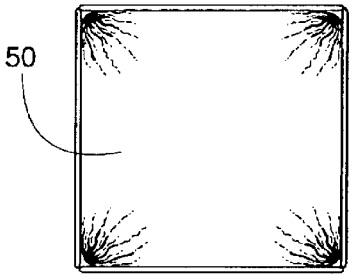
FIG. 39 is a top plan view of the collapsible structure shown in FIG. 37.
Figure 40:
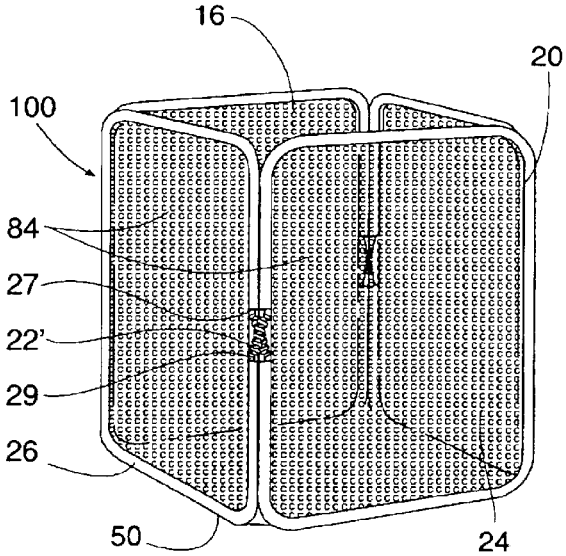
FIG. 40 is a perspective view of the collapsible structure shown in FIG. 37.

From the expanded state, the structure 10 may be folded into a collapsed state for storage and transportation. FIGS. 31 to 36 show various steps for collapsing the structure 10. Referring to FIG. 31, the first step requires grasping opposite sides of the structure 10 and biasing one toward the other until all side panels 20 are adjacent and overlay each other. The next step includes inserting the handle members 60 and 62 and the floor panel 50 in between any two of the adjacent overlaying side panels 20 is shown in FIG. 32. It is important to make sure that the storage pouch 70 remains outside of the collapsed side panels 20. In the preferred embodiment, the resulting partially collapsed structure 10 is a stack of four side panels 20. FIGS. 33 and 34 show the next step of rotating two opposite corners 101 and 103 of the partially collapsed structure 10 in opposite directions while biasing the corners 101, 103 toward each other. The structure 10 will first twist and then will rotate to form three overlaying circular loops 150 situated adjacently as shown in FIG. 35. The final step, shown in FIG. 36, is the insertion of the collapsed structure 10 into the storage pouch 70.

When the collapsed structure 10 is removed from the storage pouch 70, the frame members 22 will bias the structure 10 into its fully expanded state. Again, the fully expanded state of the embodiment is that shown in FIG. 4.

Figure 53A:
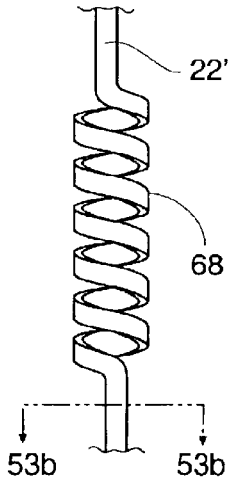
FIG. 53*a* is a view of the helical section of the frame member.
Figure 53B:
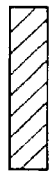
FIG. 53*b* is a cross sectional view of the frame member.
Figure 54A:
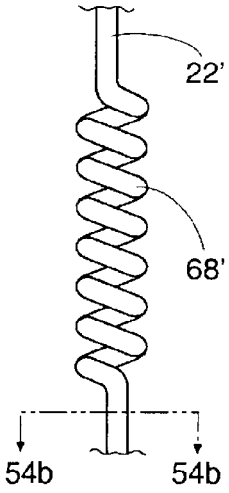
FIG. 54*a* is a view of the helical section of an alternative frame member.
Figure 54B:
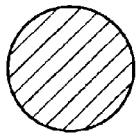
FIG. 54*b* is a cross sectional view of the alternative frame member.

Referring now to FIGS. 37–40, the preferred embodiment of the collapsible structure is shown as reference numeral 100. The structure 100 includes four side panels 20 and a floor panel 50. The side panels 20 and floor panel 50 are connected to one another to form the structure 100 having an open top 16. Two side panels 20 are connected to form a pair 84 of side panels 20. Two pair 84 of side panels 20 are preferably used to form the structure 100. The preferred embodiment in these views includes a single modified frame 22' for each pair 84 of side panels 20. Each side panel 20 further comprises a web 24 and an edging 26. As in the previous embodiments, the web 24 is a flexible foldable material, such as nylon cloth or nylon mesh, but any suitable material may be used. The material may be solid or perforated, as desired. The frame 22' is flexible, preferably formed from a sufficiently stiff yet resilient material such as spring steel wire or plastic, and similarly to the previously described embodiments, is contained within the channel or pocket 25 (seen in FIG. 55) formed by the edging 26. The edging 26 is a foldable, but stretch-resistant material capable of housing the modified frame 22' within its pocket 25. The edging 26 has two ends, 27 and 29. The frames 22' are each formed in a "figure eight" configuration as will be discussed in more detail. As shown in FIG. 53*b*, the frame 22' has a rectangular cross-section, but a material with a different geometric cross-section may be used. For purposes of example only, an alternative cross-section, seen as circular, is shown in FIG. 54*b*.

Figure 41:
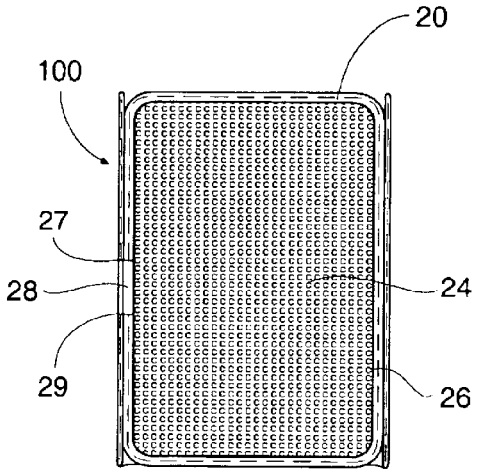
FIG. 41 is a front plan view of another alternative embodiment of the collapsible, two-frame structure showing seam covers over the frame insertion points.
Figure 42:
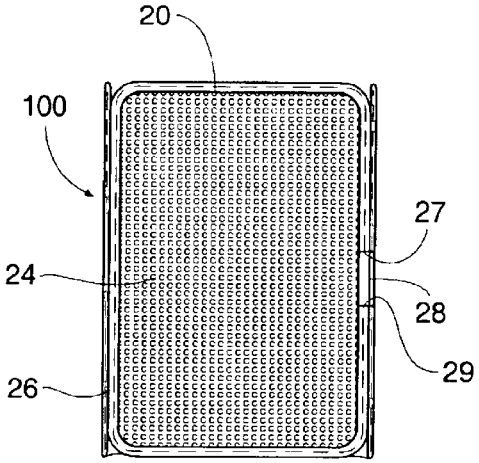
FIG. 42 is a side plan view of the collapsible structure shown in FIG. 41.
Figure 43:
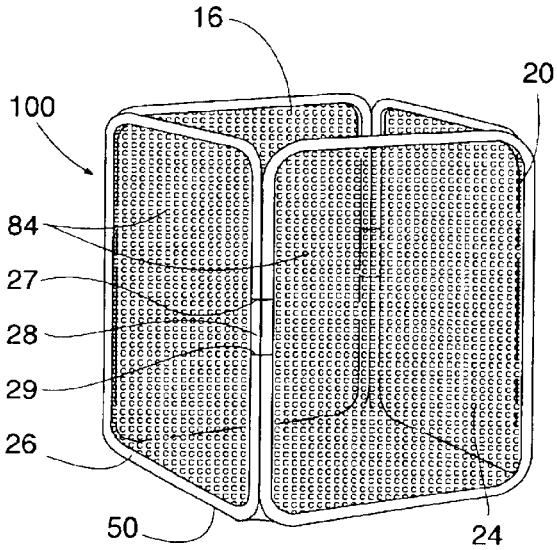
FIG. 43 is a perspective view of the collapsible structure shown in FIG. 41.

FIGS. 41–43 illustrate another embodiment of the two frame structure 100. In this embodiment, a seam cover 28 is stitched to each web 24 and over the open ends 27 and 29 of each edging 26, thereby protecting the frame 22' from escaping the edging 26. Each seam cover 28 includes a flap or unstitched portion, and it is to be understood that it could be placed anywhere on any side of each of the webs 24, depending on the insertion point of the frame 22' defined by the open ends 27 and 29.

Figure 44:
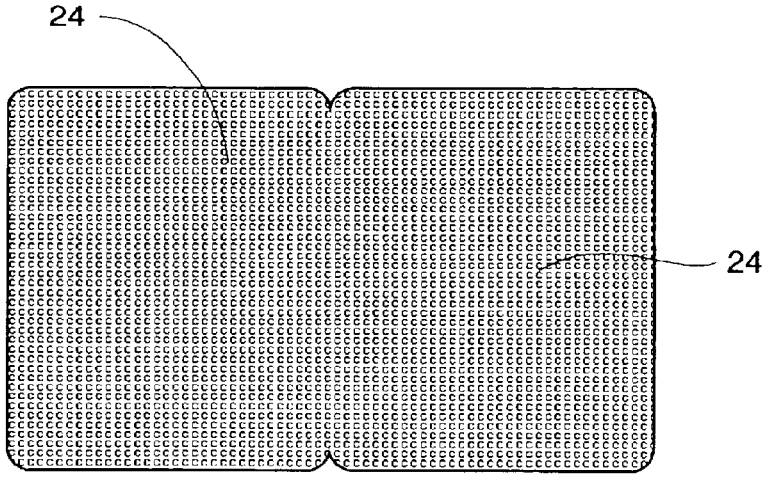
FIG. 44 is a side plan view of a pair of side panels.
Figure 45:
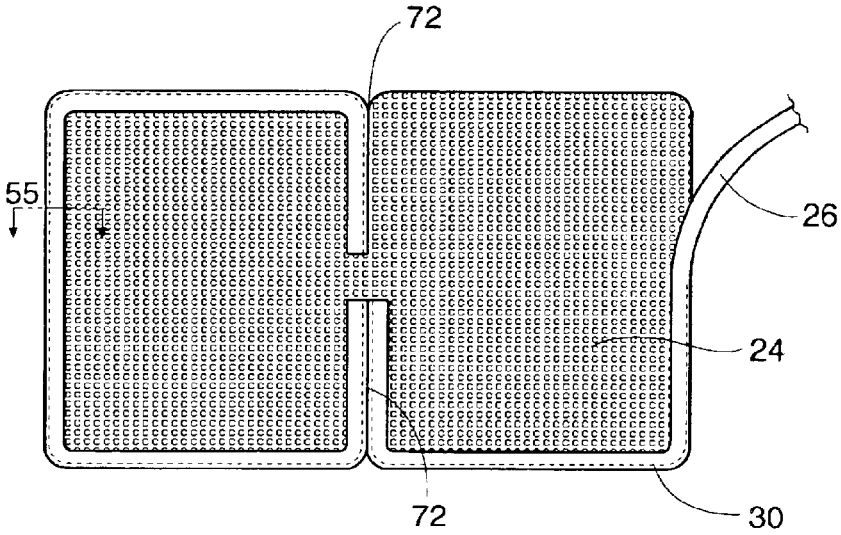
FIG. 45 is a side plan view of the side panels with the edging partially attached.
Figure 46:
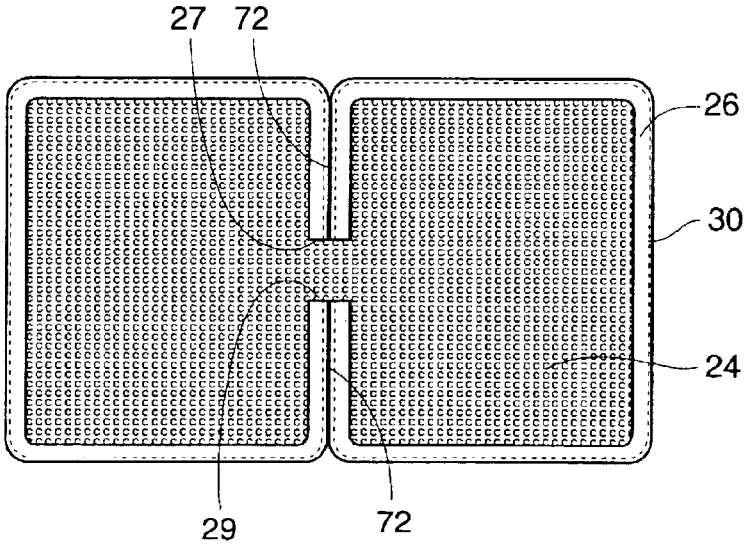
FIG. 46 is a side plan view of the side panels with the edging attached.

FIGS. 44–49 illustrate the various stages in the manufacturing process of the two-frame structure 100 shown in FIGS. 37–40. To form the first pair 84 of contiguous side panels 20, two integrally formed, contiguous webs 24 seen in FIG. 44, are provided. Edging material 26 is then attached to the web 24 perimeter and a portion of the contiguous border 72, as shown in FIG. 45. The edging 26 is folded in a channel-like fashion around the periphery of the web 24 and stitched to the web 24, with stitching 30. The folded and stitched edging 26 forms a pocket 25 (seen best in FIG. 55) around the periphery of the web 24. Stitching of each edging 26 starts and ends at the open ends 27 and 29, preferably located at the contiguous border 72.

Figure 47:
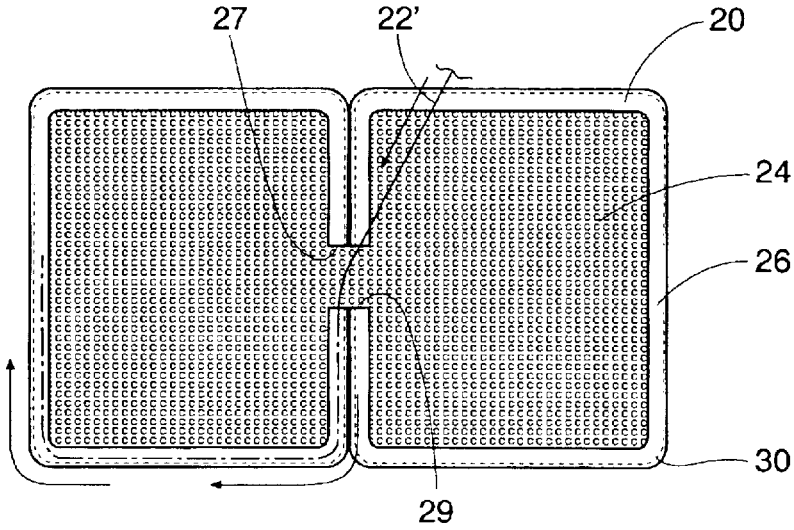
FIG. 47 is a side plan view of the side panels and edging with the frame member being partially inserted.
Figure 48:
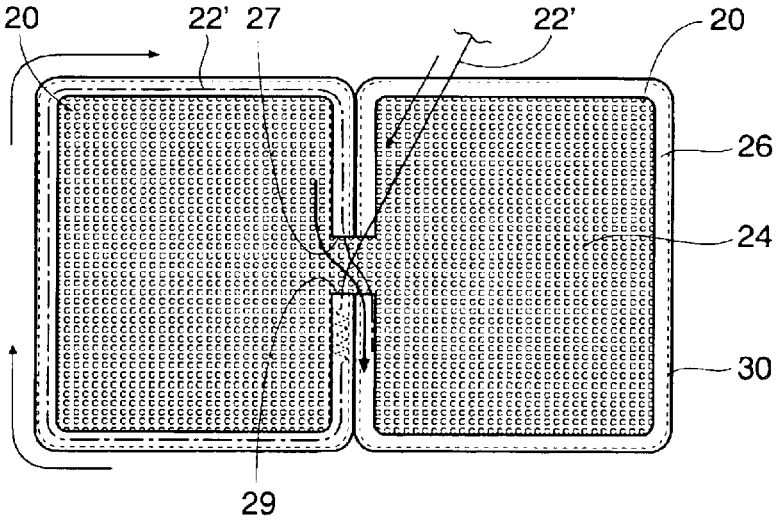
FIG. 48 is a side plan view of the side panels and edging with the frame member completely around one side panel and partially inserted around the other side panel.
Figure 49:
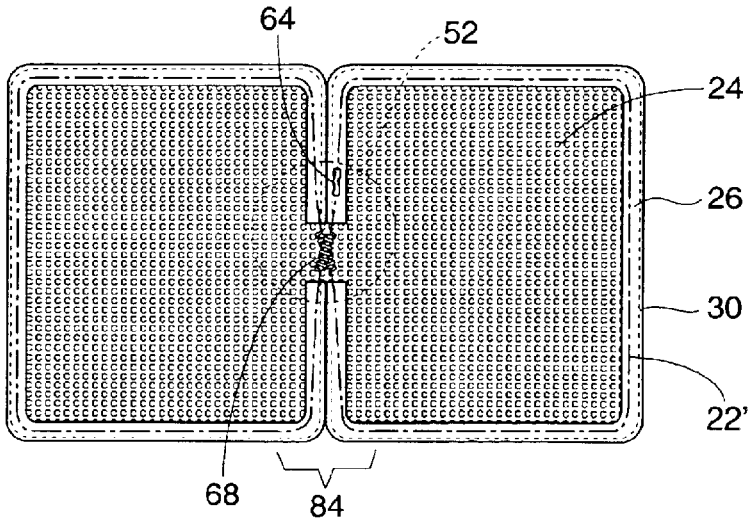
FIG. 49 is a side plan view of the side panels and edging with the frame member ends connected.
Figure 50:
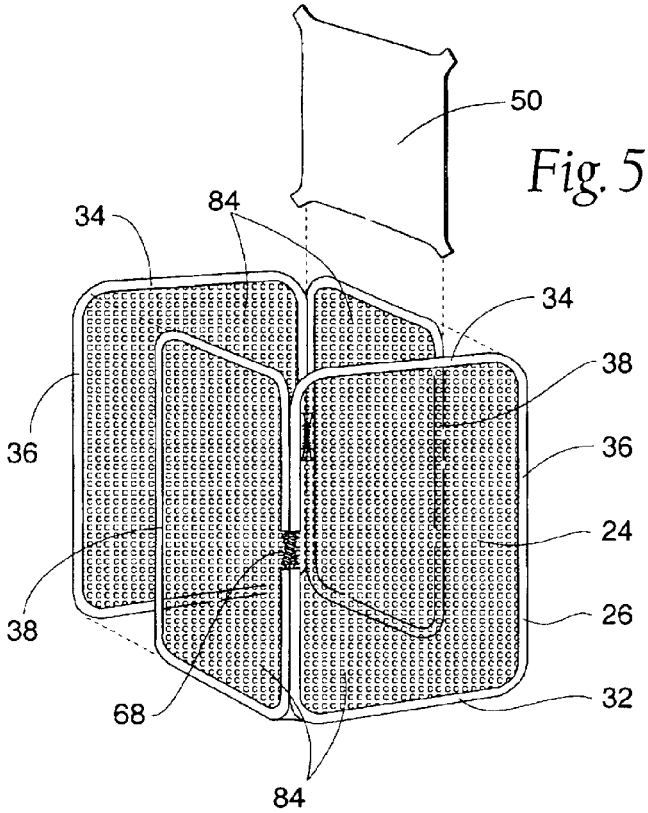
FIG. 50 is a perspective view of two side panel pairs with the panels inverted to show placement of the floor panel 50.
Figure 51:
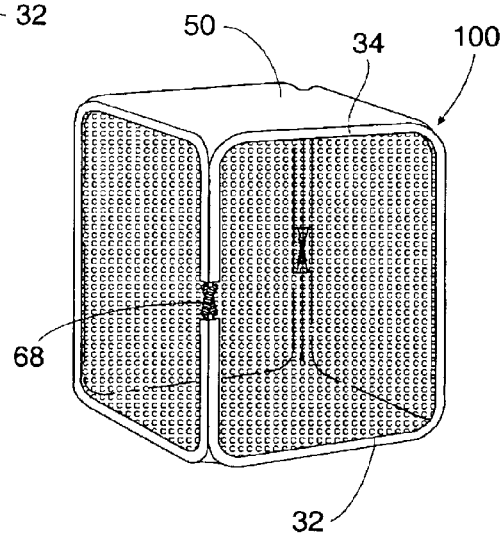
FIG. 51 is an inverted perspective view of two side panel pairs, attached to one another and with the floor panel in place.
Figure 51B:
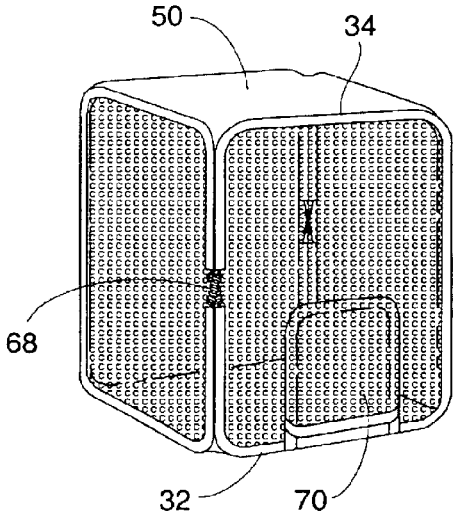
FIG. 51*b* is an inverted perspective view of the collapsible structure shown in FIG. 51, but including an optional storage pouch 70.
Figure 52:
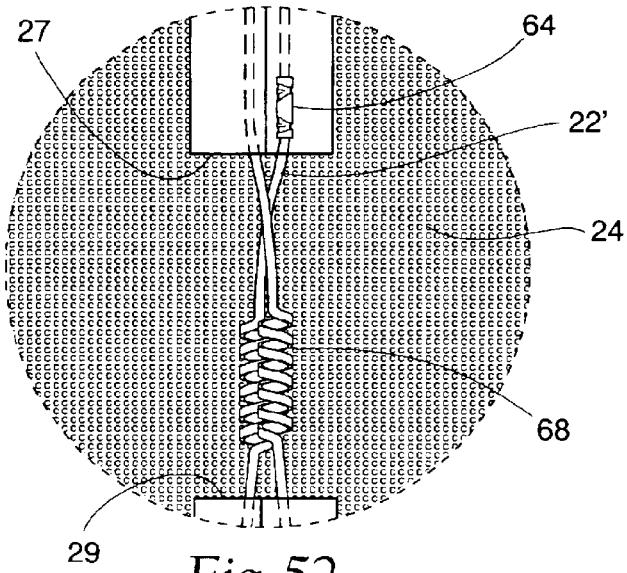
FIG. 52 is an enlarged view of the area 52 shown in FIG. 49, and showing the helical spring section of the frame member.

The next steps of the manufacturing process of the present invention involve inserting the frame 22' in one of the open ends 27 or 29 of the edging 26 as shown in FIG. 47. The frame 22' is passed through the edging 26 and around the periphery of each of the side panels 20. As the frame 20' completes its circuit around the first side panel 20, it crosses over itself at open end 27, 29 to form a "figure eight" as it enters the edging 26 of the second panel 20. When the frame 22' is completely inserted in the pocket 25 surrounding both panels 20, the ends of the frame 22' are joined together at a helical portion 68 such that the frame 22' forms a continuous loop. In the preferred embodiment, the frame ends are connected by inserting each end into a butt connector 64 and crimping the connector 64 (see in particular FIG. 52). The steps shown in FIG. 44–49 are completed a second time to form a second pair 84 of contiguous side panels 20. As illustrated in FIGS. 50 51*b*, the first and second pair 84 of contiguous side panels 20 are positioned to form the structure 100. The floor panel 50 is attached to the floor side 34 of panels 20, as shown particularly in FIG. 50, and the first and second pair 84 of contiguous side panels 20 are attached to one another along the edging 26 of lateral sides 36, 38 of panels 20. As shown in FIG. 51*b*, an optional storage pouch 70 may be formed from a foldable material, such as nylon mesh, and stitched to the top side 32 of one of the panels 20. The storage pouch 70 is dimensioned to accommodate the structure 100 in its collapsed state, as will be described.

As will be observed in FIGS. 52–54*b*, the frame 22' includes a helical portion 68, 68'. The helical portion 68 has a relatively flat cross section whereas the portion 68' may be formed with a circular cross section. The helical portions 68, 68' provide a means for expansion and contraction of the frame 22' which allows facile folding and unfolding of each individual pair 84 of panels 20, as will be later described.

Figure 55:
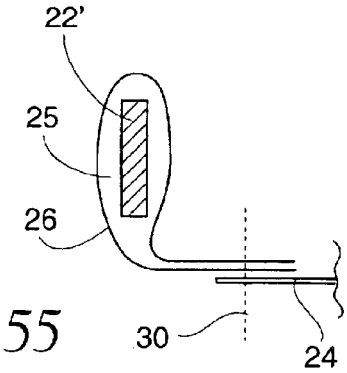
FIG. 55 is a cross sectional view taken along lines 55—55 of FIG. 46 and showing the frame member in the edging.
Figure 56:
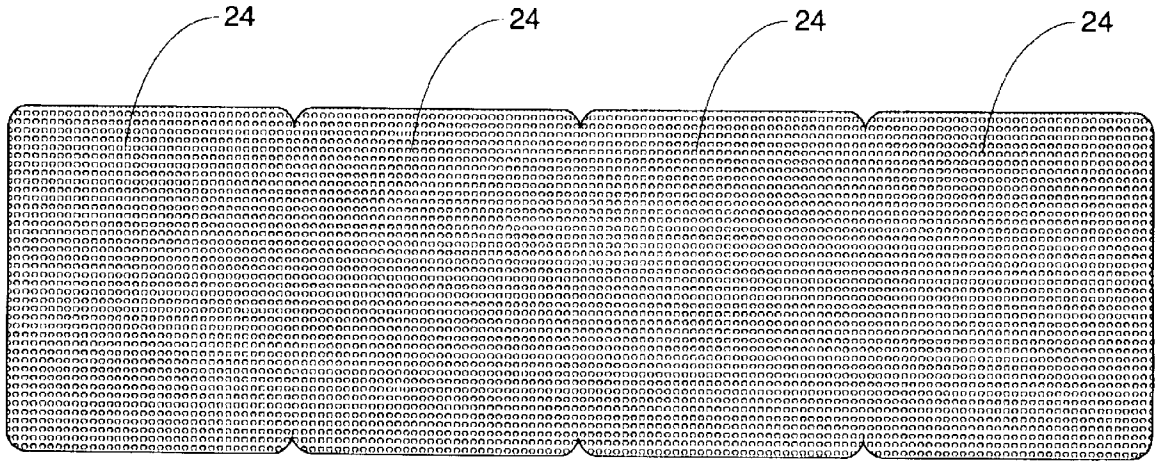
FIG. 56 is a side plan view of four contiguous side panels.
Figure 57:
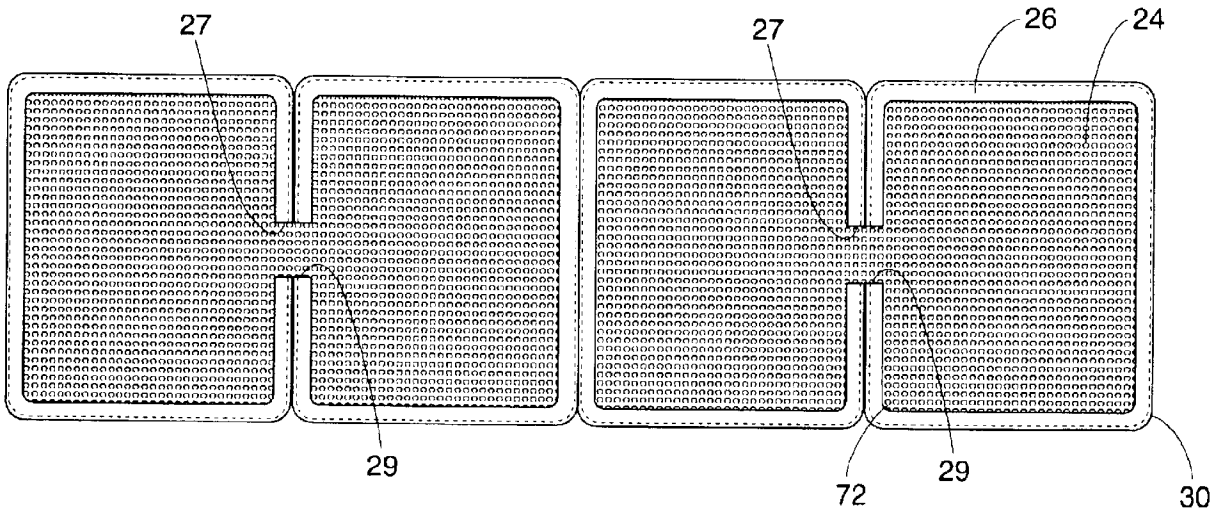
FIG. 57 is a side plan view of the four contiguous side panels seen in FIG. 56, but with the edging attached.
Figure 58:
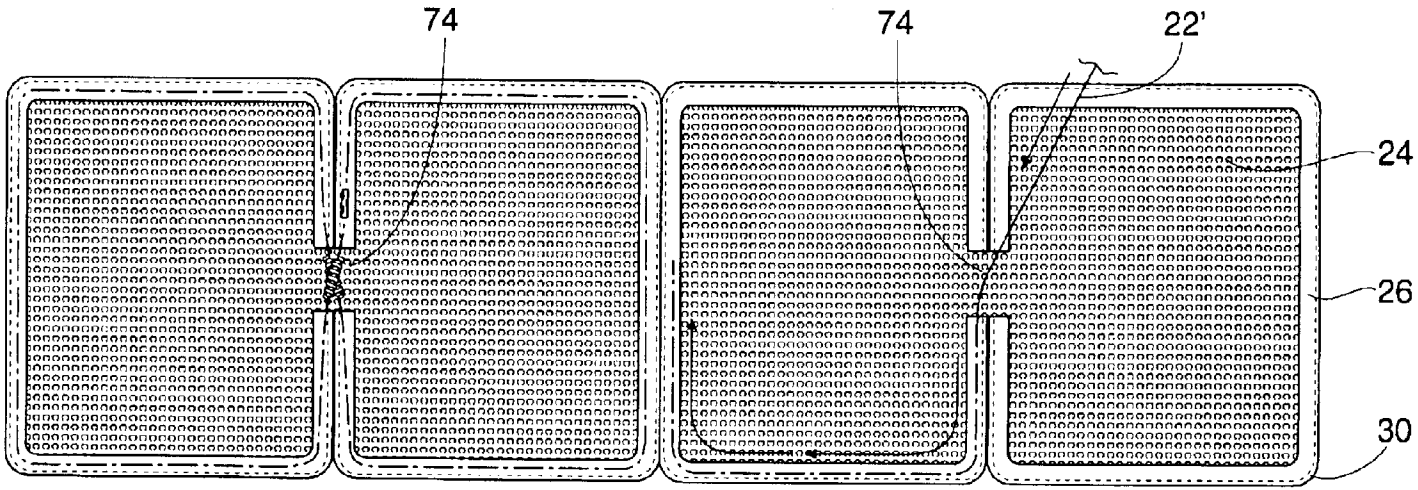
FIG. 58 is a side plan view of the four contiguous side panels seen in FIG. 57, with a frame member completely around two side panels and a second frame member partially inserted around the two remaining side panels.

FIGS. 56–60*b* illustrate an alternative manufacturing process of the two-frame structure 100. Seen particularly in FIG. 56, four integrally formed, contiguous webs 24 are provided. As shown in FIG. 57, edging material 26 is then attached to the web 24 perimeter and a portion of the contiguous border 72, leaving insertion areas 74 defined by open ends 27 and 29. Similarly to the previous embodiments, the edging 26 is folded in a channel-like fashion around the periphery of the web 24 and stitched to the web 24 with stitching 30. As seen in FIG. 55, the folded and stitched edging 26 forms a pocket 25. Stitching of each edging 26 starts and ends at open ends 27 and 29.

Figure 59:
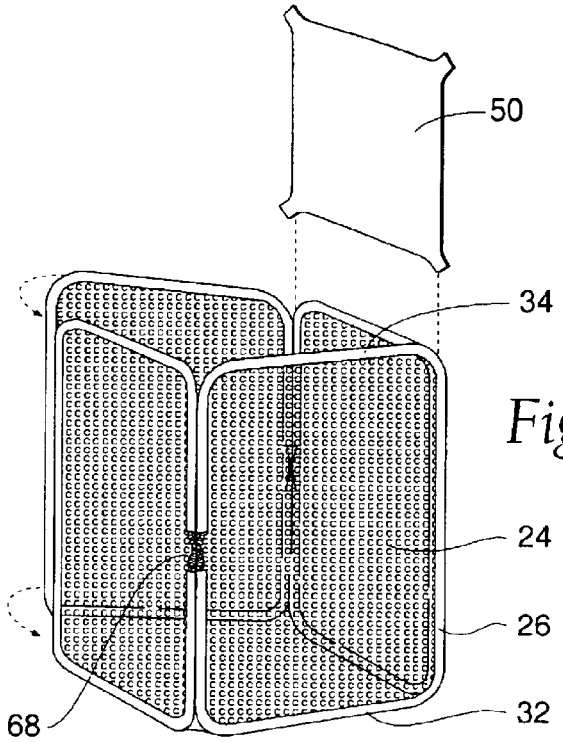
FIG. 59 is a perspective view of the four contiguous side panels seen in FIG. 58, but in inverted position to show placement of the floor panel 50.
Figure 60:
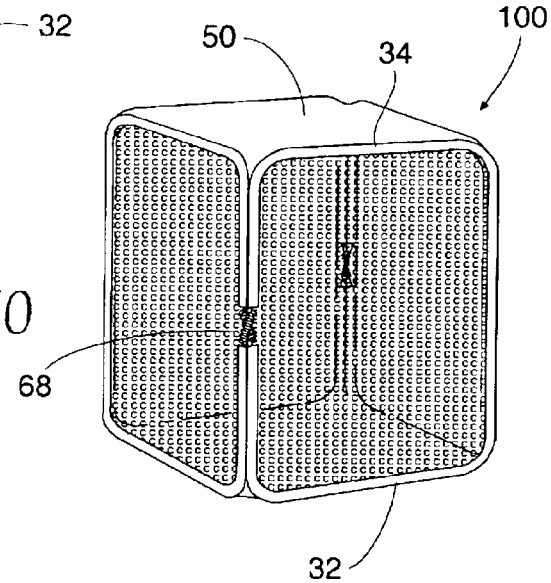
FIG. 60 is an inverted perspective view of four contiguous side panels with free ends attached to one another and the floor panel in place.
Figure 60A:
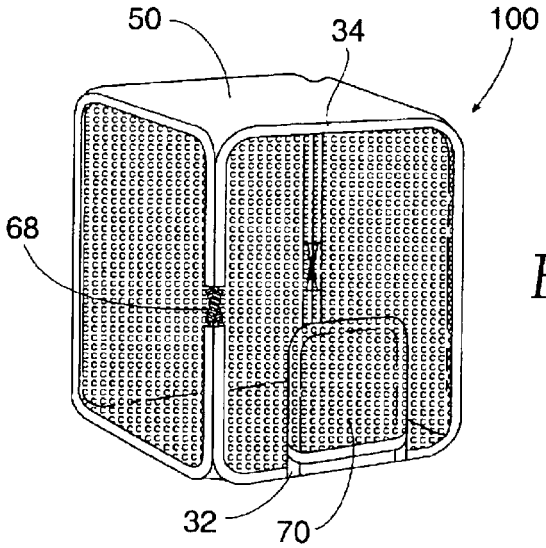
FIG. 60*a* is an inverted perspective view of the collapsible structure shown in FIG. 60, but including an optional storage pouch 70.
Figure 61:
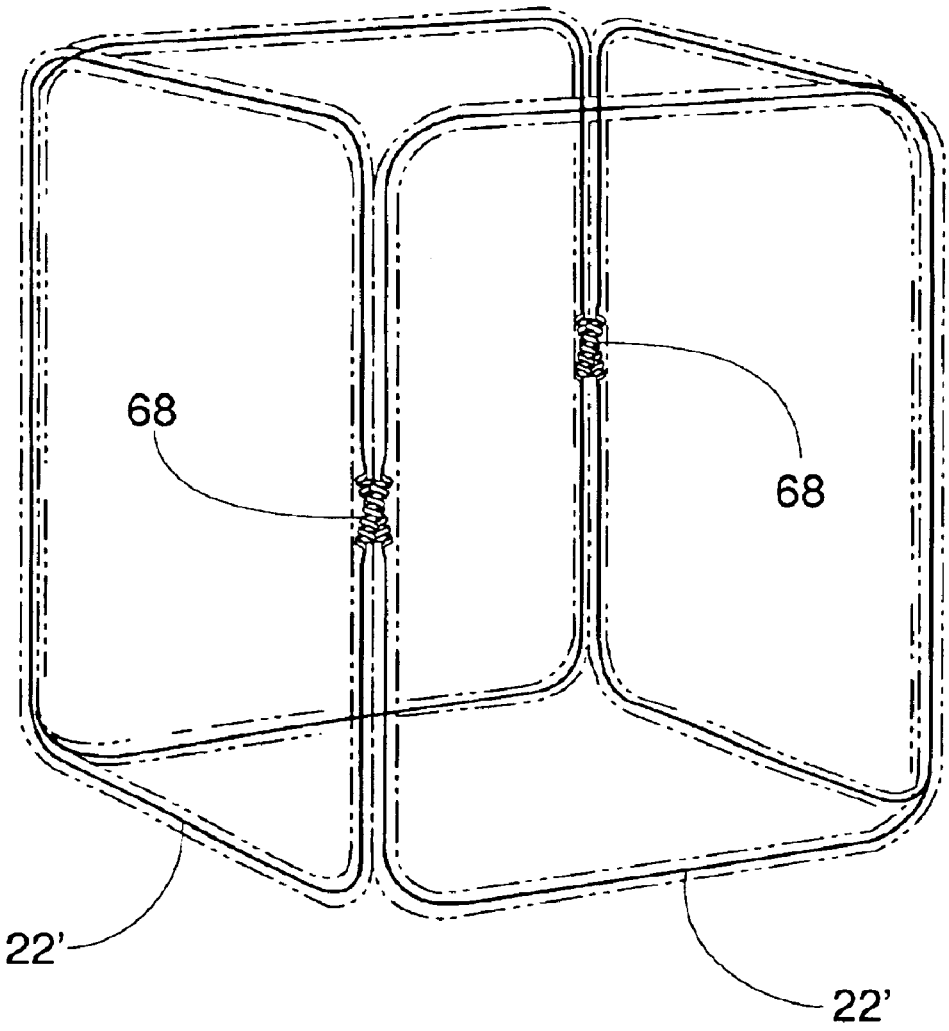
FIG. 61 is a view showing the position of two frames around a four panel collapsible structure.

The next step in the alternative manufacturing process involves inserting a frame 22' at each insertion area 74, in an open end 27 or 29 of the edging 26. As described with reference to FIG. 46, each frame 20' of the embodiment shown in FIG. 58 completes its circuit around a panel 20, crosses over itself at insertion area 74, and enters a second panel 20 in open end 27 or 29. After the frame 22' is completely inserted in the pocket 25 surrounding two adjacent panels 20, the ends of the frame 22' are joined together to form a continues loop. A crimped butt connector 64 retains the ends. The alternative method of manufacture is completed as seen in FIGS. 59 and 60 in a manner similar to that described with reference to FIGS. 50 and 51. The method may optionally include a storage pouch 70, as seen in FIG. 60*b*.

Figure 62:
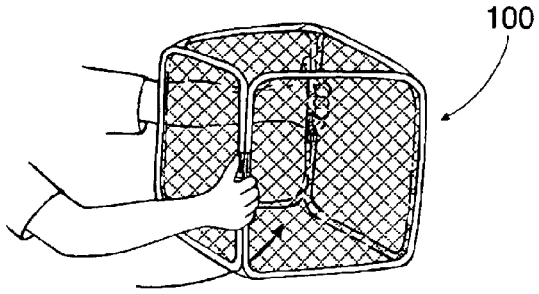
FIGS. 62–67 depict the method of collapsing the collapsible structure, but using a flexible band to hold the collapsed bag in collapsed state.
Figure 65:
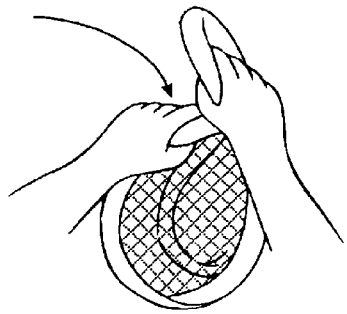
Figure 63:
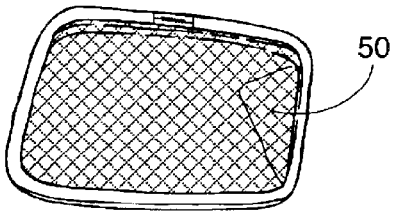
Figure 66:
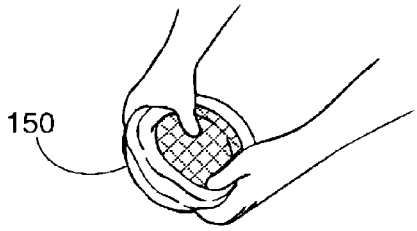
Figure 64:
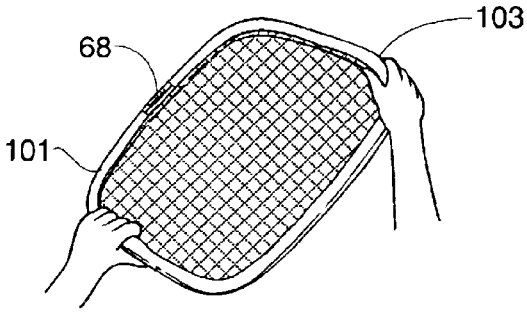

As discussed in reference to the primarily described embodiments shown in FIGS. 1–30, the two frame structure 100 of FIGS. 37–61 may, from the expanded state, be folded into a collapsed state for storage and transportation. FIGS. 31 to 36 show various steps for collapsing the structure 10, and the two frame structure 100 is similarly collapsed, as shown in FIGS. 62–67. Referring to FIG. 62, the first step requires grasping opposite sides of the structure 100 and biasing one toward the other until all side panels 20 are adjacent and overlay each other. The next step includes inserting the handle members 60 and 62, if provided, and the floor panel 50 in between any two of the adjacent overlaying side panels 20 is shown in FIG. 63. It is important to make sure that the storage pouch 70, if provided, remains outside of the collapsed side panels 20 (as shown in FIG. 33). The resulting partially collapsed structure 100 is a stack of four side panels 20. FIGS. 64 and 65 show the next step of rotating two opposite corners 101 and 103 of the partially collapsed structure 100 in opposite directions while biasing the corners 101, 103 toward each other. The structure 100 will first twist and then will rotate to form three overlaying circular loops 150 situated adjacently as shown in FIG. 66. The final step, shown with reference to structure 10 in FIG. 36, is the insertion of the collapsed structure 10, 100 into the storage pouch 70, if provided.

When the collapsed structure 100 is removed from the storage pouch 70, the frame members 22 will bias the structure 100 into its fully expanded state.

Figure 67:
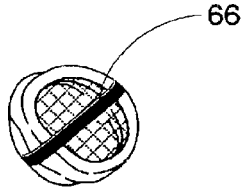
Figure 68:
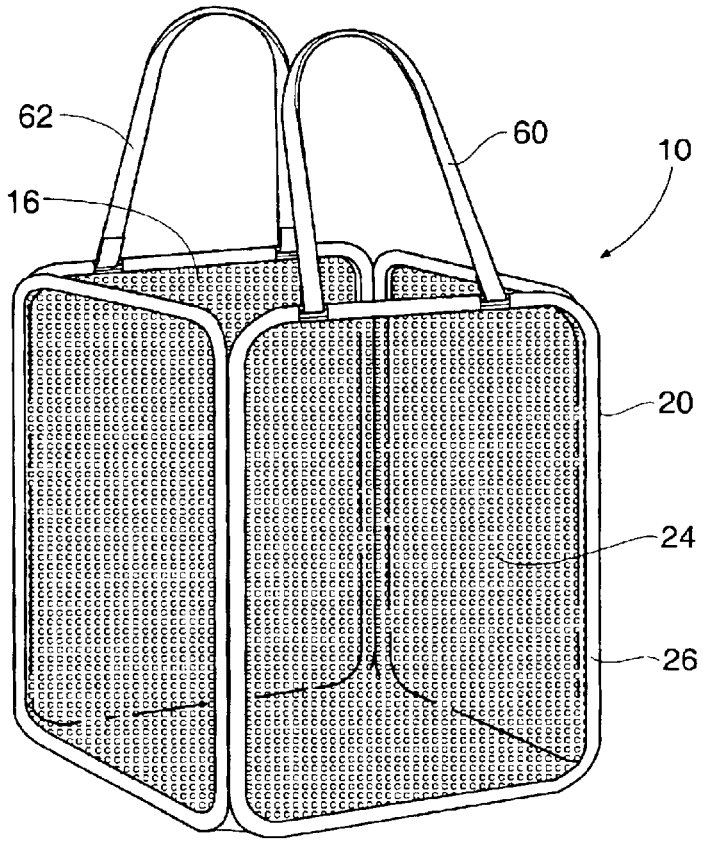
FIG. 68 is a perspective view of an alternative embodiment collapsible structure and showing the handle members looped around the frame.
Figure 69:
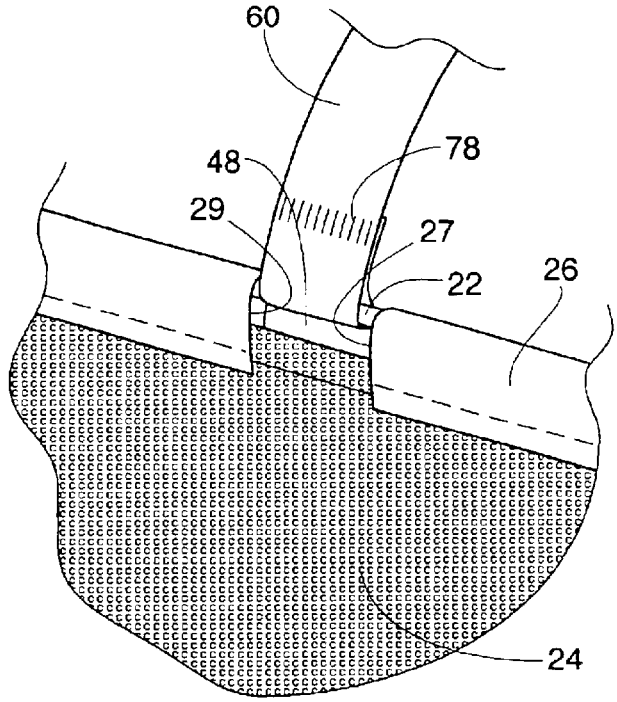
FIG. 69 is a fragmentary, enlarged view of the embodiment shown in FIG. 68, with a handle member looped around the frame.

An alternative folding step may be seen in FIG. 67 wherein the two frame structure 100 may be finally secured in the collapsed state by way of an elastic flexible band 66.

Figure 6B:
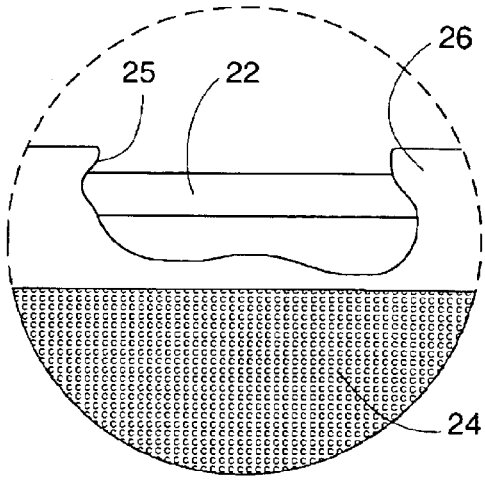
FIG. 6B is a partially cut-away view from FIG. 6A showing the frame member 22.
Figure 7:
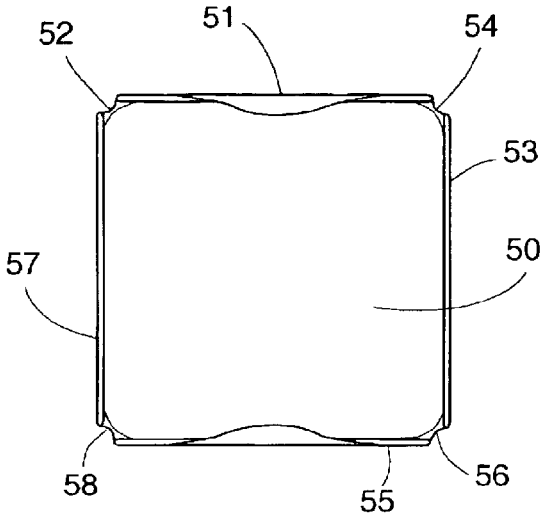
FIG. 7 is a top plan view of the collapsible structure.
Figure 70A:
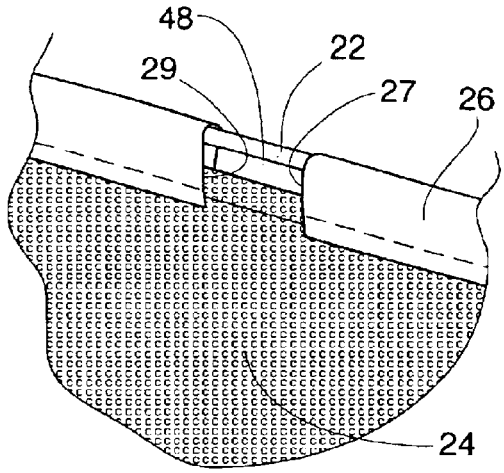
FIGS. 70*a*–70*c*, inclusive, depict the method by which the handle shown in FIG. 69 is looped around the frame.
Figure 70B:
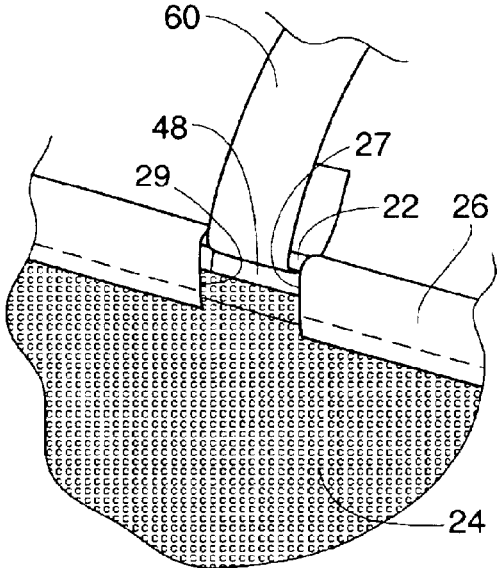
Figure 70C:
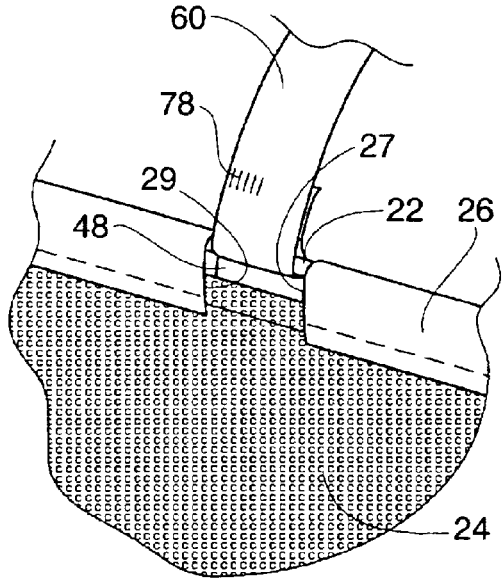

FIGS. 68–70*c*, inclusive, illustrate a further embodiment of the collapsible structure 10. Each side panel 20 comprises a frame 22, a web 24, and an edging 26. As in the previously mentioned embodiments, the frame 22 is flexible, preferably formed from a sufficiently stiff yet resilient material such as spring steel wire or plastic, and is contained within the channel or pocket 25 formed by the edging 26 (as seen in FIG. 6*b*). The perimeter of the web 24 is stitched to the edging 26 such that the edging 26 forms a pocket 25 substantially about the periphery of the web 24. At least one of the webs 24 includes edging 26 having a non-continuous gapped portion 48. The gap 48 defines an area wherein the frame 22 is exposed. As illustrated in FIGS. 70*a*–70*c*, a handle 60 may be inserted in the gap 48 between edging ends 27 and 29. After insertion in gap 48, the handle 60 is looped around the frame 22. As seen particularly in FIG. 70*c*, the handle 60 may be stitched at 78 for securement after insertion in gap 48. Alternatively, the handle 60 may be affixed to itself or the frame member with adhesive or another securement means. Both handles 60 and 62 may be attached in this manner.

It is to be understood that although not specifically illustrated in the Figures, handles 60 and 62 may be secured by looping around the frame 22 of any of the foregoing embodiments.

FIGS. 71–77, inclusive, illustrate a further embodiment of the collapsible structure 200. The structure 200 preferably includes four side panels 20 and a floor panel 50. The side panels 20 and floor panel 50 are connected to one another to form a substantially rectangular structure having an open top 16.

Figure 71:
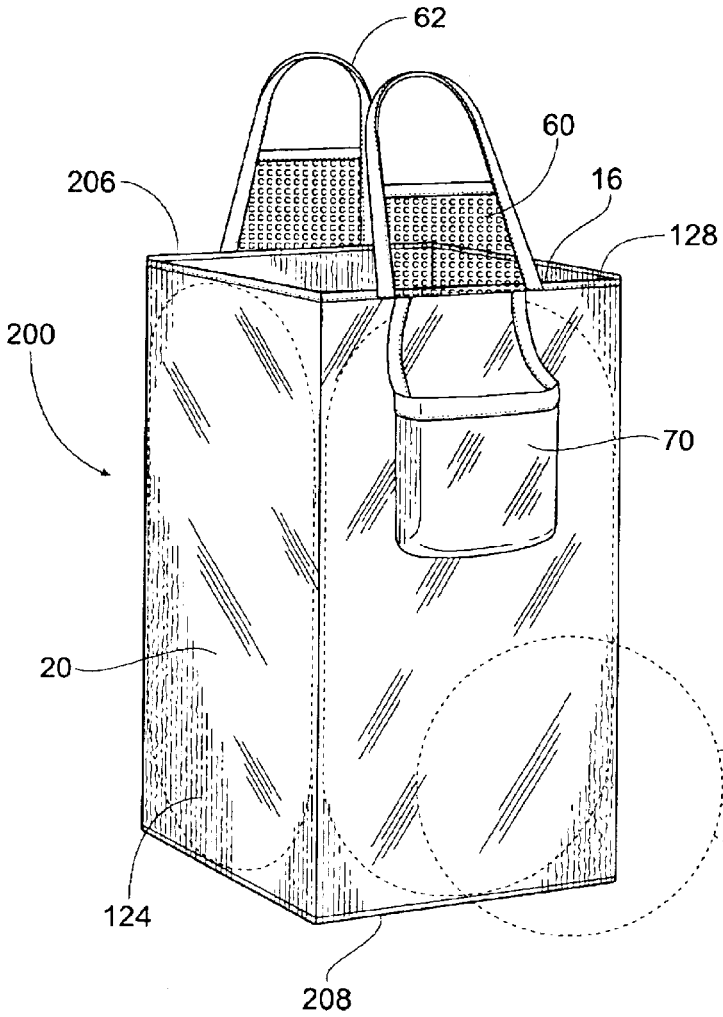
FIG. 71 is a perspective view of another alternative embodiment collapsible structure having two-ply side panels.
Figure 72:
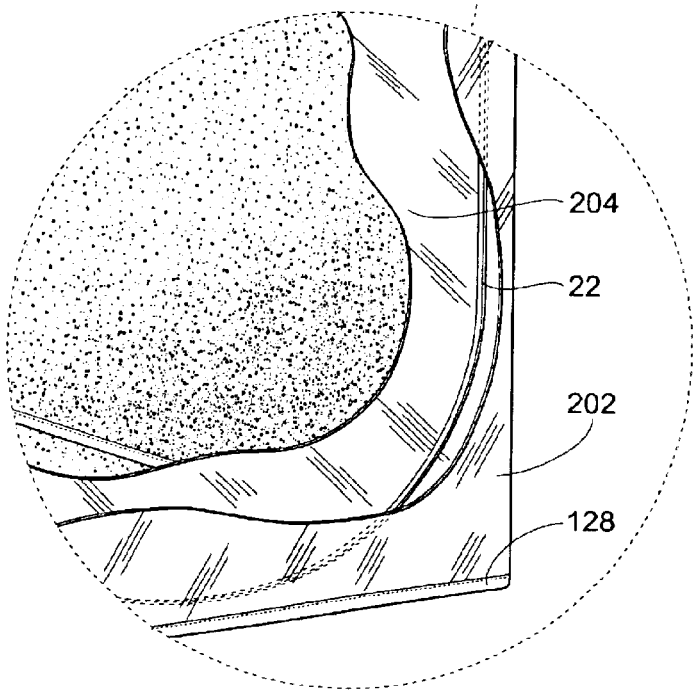
FIG. 72 is an enlarged, fragmentary view of the area 300 shown in FIG. 71, and showing the continuous loop frame captured between the two layers of web material.

Referring to FIGS. 71 and 72 it may be seen that each side panel 20 comprises a frame 22 and a two-ply web 124. As in the previously mentioned embodiments, the frame 22 is flexible, preferably formed from a is sufficiently stiff, yet resilient, material such as spring steel wire or plastic. In the embodiment shown in FIGS. 71–77, and as seen particularly in FIG. 72, the frame 22 is captured between the two layers 202, 204 of the two-ply web 124. The frame 22 forms a loop. The looped frame 22 may or may not be continuous. Preferably, and similarly to the previously described embodiments, the frame 22 has a rectangular cross-section, however material having a different geometric cross-section may be used. The two layers 202, 204 of the web 124 may be made from any flexible, foldable material, including but not limited to nylon or cotton cloth. The nylon or other flexible material is preferably solid, rather than perforated to more easily retain the frame 22 between the layers 202, 204 of the web 124; however a suitably perforated material may be used.

The top 206 and bottom 208 perimeter of the two-ply web 124 is preferably stitched to seam cover 128 such that the bottom 208 perimeter is thereby attached to the floor panel 50. The seam cover 128 is preferably made from a foldable stretch-resistant material.

Figure 73:
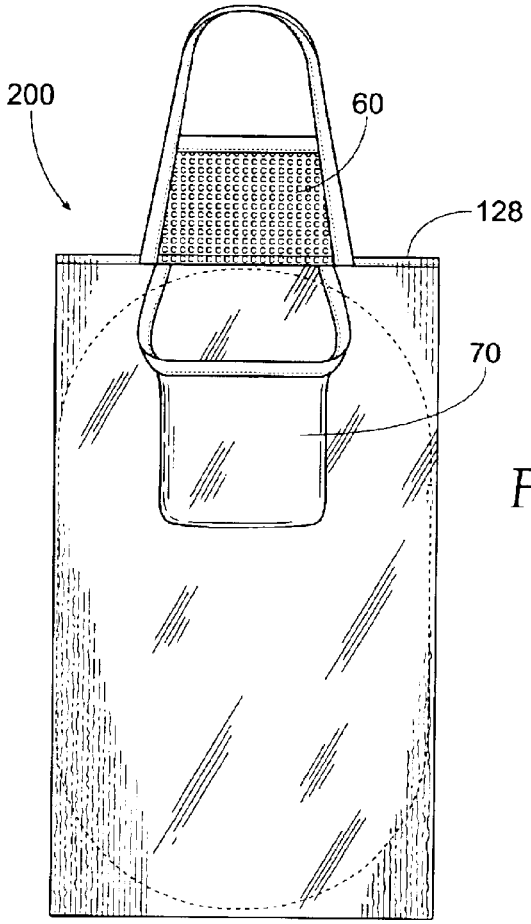
FIG. 73 is a side plan view of the collapsible structure shown in FIG. 71.
Figure 74:
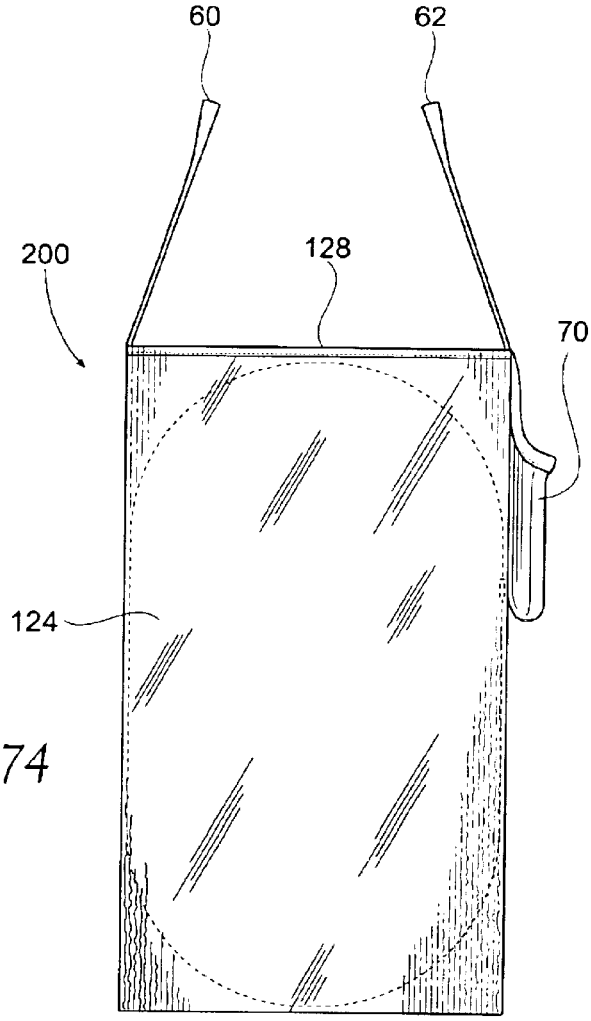
FIG. 74 is a front plan view of the collapsible structure shown in FIGS. 71 and 73.
Figure 75:
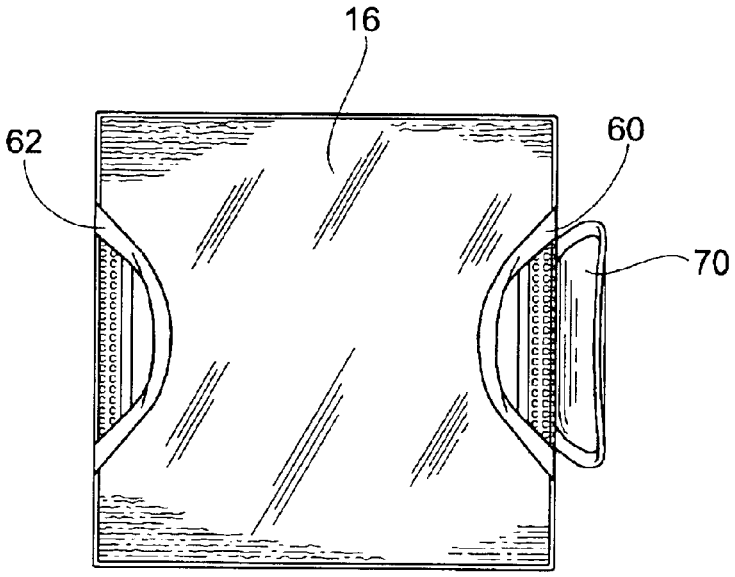
FIG. 75 is a top plan view of the collapsible structure shown in FIGS. 71, 73 and 74.
Figure 76:
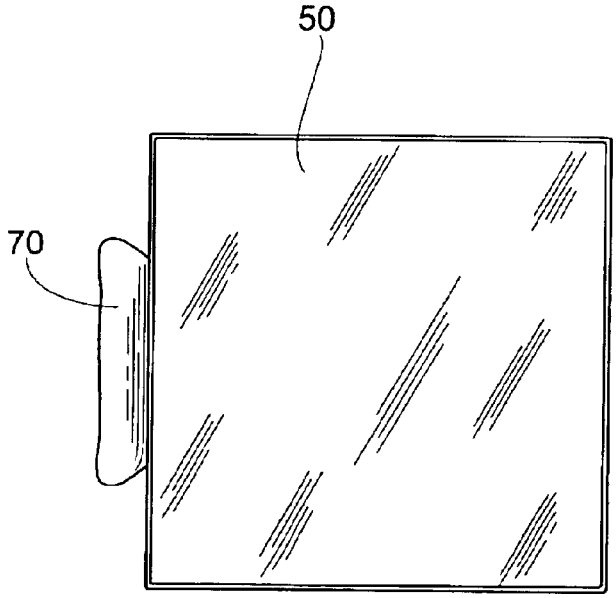
FIG. 76 is a bottom view of the structure shown in FIGS. 71, and 73–75.

As may be seen particularly in FIGS. 71 and 73, handles 60 and 62 may be attached to the top side 206 of two opposing side panels 20. As discussed with regard to previous embodiments, the handles 60 and 62 are formed from a stretch-resistant material having a mesh web that extends between a portion of each strap side. It is to be understood that the handles for the present invention are not limited to the particular type shown in FIGS. 71–77, but may include other designs as previously illustrated in FIGS. 9–12, by way of example.

As may be seen in FIGS. 71, 73–76, an optional storage pouch 70 may be formed from a foldable material, such as nylon mesh, and stitched to the side of one of the panels 20. As in the previously described embodiments, the storage pouch 70 is dimensioned to accommodate the structure 200 in its collapsed state.

Although stitching is presented as the preferred means for attaching or connecting the elements of the structure and permitting relatively convenient folding of the structure 200, it is to be understood that other attachment means may be used in this invention.

Figure 77:
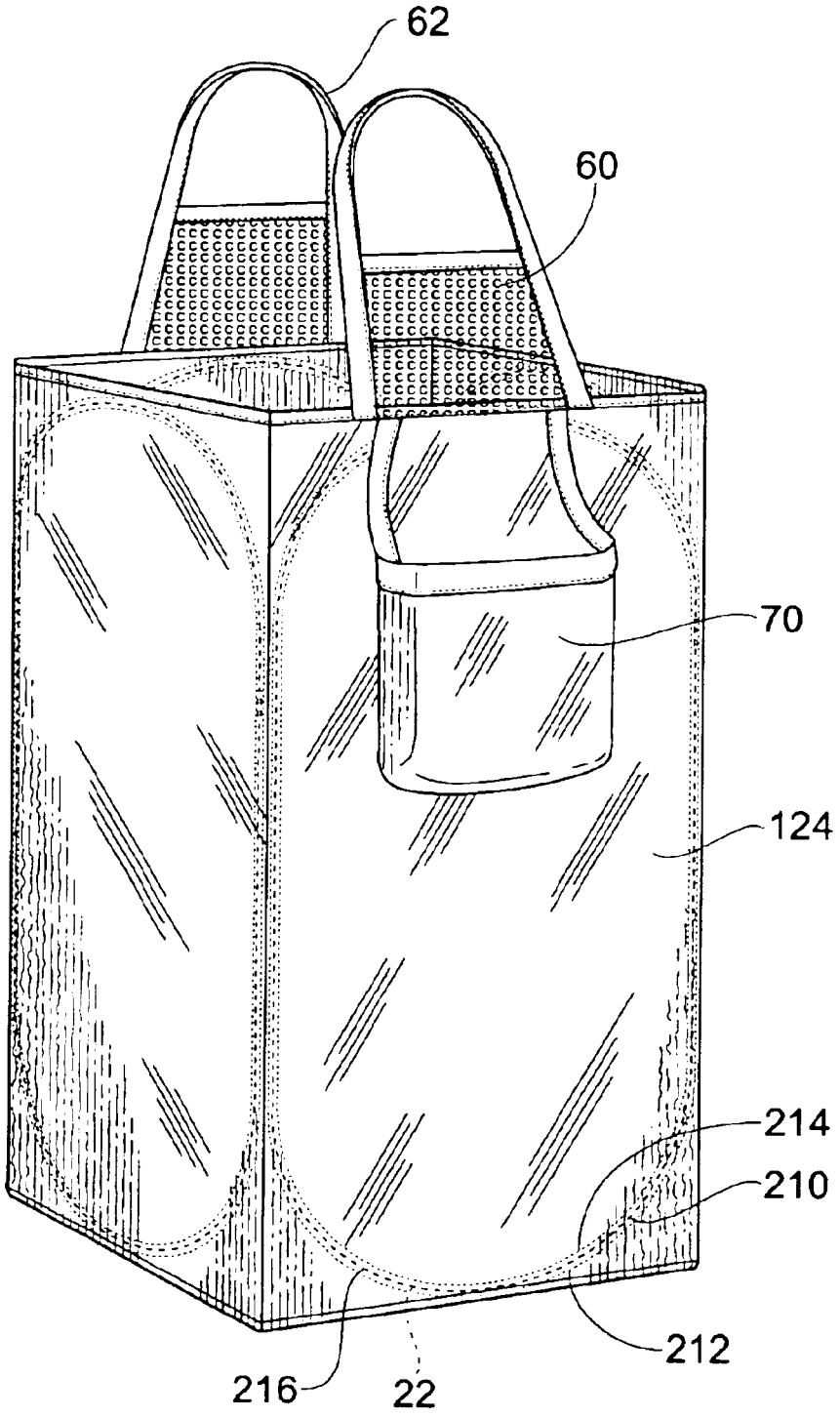
FIG. 77 is a perspective view, similar to that of FIG. 71, but showing the two layers of web material being stitched together around the loop frame.

FIG. 77 depicts a variation of the embodiment illustrated in FIGS. 71–76. In this view, the structure 200 further includes frame stitching 210. The frame stitching 210 preferably extends through the two layers 202, 204 of the two-ply web 124. The frame stitching 210 is preferably substantially parallel to the frame member 22 and, as shown, may comprise a pair of substantially parallel stitch lines 212, 214. When the frame stitching 210 is presented as a pair of stitch lines 212, 214, the frame member 22 is preferably positioned between the stitch lines 212, 214 such that the frame 22 is captured within a stitch channel 216. This arrangement more positively positions the frame 22 between layers 202, 204. It is to be understood that while the Figures illustrate continuous stitch lines 212, 214 of frame stitching 210, the invention may be practiced using a non-continuous or interrupted stitch line as well.

Figure 78:
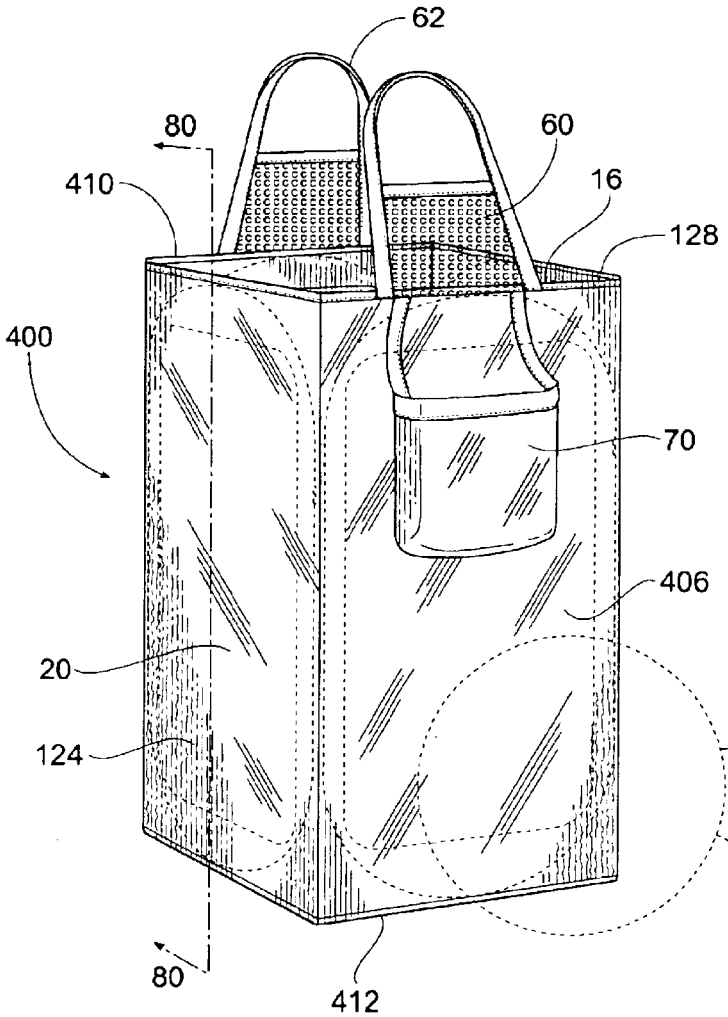
FIG. 78 is a perspective view of yet another alternative embodiment collapsible structure having two-ply side panels.
Figure 79:
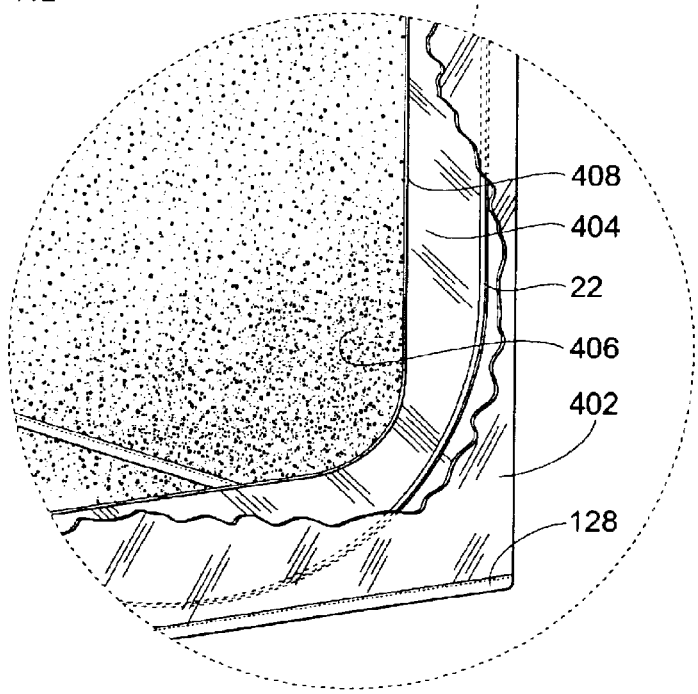
FIG. 79 is an enlarged, fragmentary view of the area 500 shown in FIG. 78, and showing the continuous loop frame captured between the two layers of web material.
Figure 80:
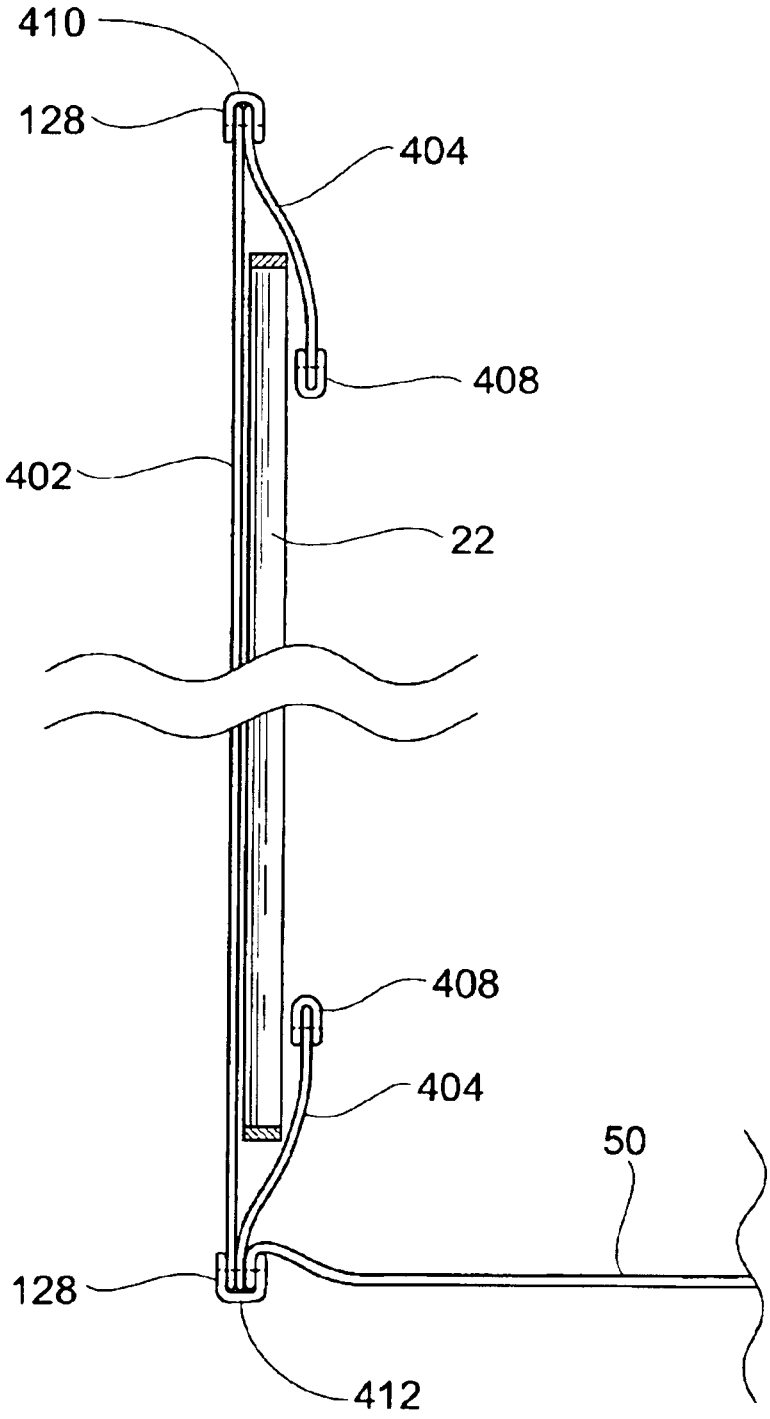
FIG. 80 is a cross sectional view taken along line 80—80 of FIG. 78.

FIGS. 78–80 illustrate another embodiment of the collapsible structure 400. The structure 400 preferably includes four side panels 20 and a floor panel 50. The side panels 20 and floor panel 50 are connected to one another for form a substantially rectangular structure having an open top 16.

Referring to FIGS. 78 and 79, it may be seen that each side panel 20 comprises a frame 22 and a two-ply web 124. As in the previously discussed embodiments, the frame 22 is flexible, preferably formed from a sufficiently stiff, yet resilient, material such as spring steel wire or plastic. In this embodiment, and as seen particularly in FIG. 79, the frame 22 is captured between the two layers 402 and 404 of the two-ply web 124. The frame 22 forms a continuous loop. Preferably, and similarly to the previously described embodiments, the frame 22 has a rectangular cross-section; however material having a different geometric cross-section may be used. The two layers 402 and 404 of the web 124 may be made from any flexible, foldable material including but not limited to nylon or cotton cloth. The nylon or other flexible material is preferably solid, rather than perforated to more easily retain the frame 22 between the layers 402 and 404 of the web 124; however a suitable perforated material may be used. In this embodiment, layer 402 is a continuous, non-interrupted web of material. Layer 404 is annular in shape having an opening 406 in its central region. The opening 406 can be of any shape and size. If desired, an edging 408 may be stitched around the inner perimeter of the opening 406.

The top 410 and bottom 412 perimeter of the two-ply web 124 is preferably stitched to seam cover 128 such that the bottom perimeter is thereby attached to the floor panel 50. The seam cover 128 is preferably made from a foldable stretch-resistant material.

As best shown in FIG. 80, frame 22 is captured between the layers 402 and 404. In this embodiment, each frame member 22 may be easily removed from the collapsible structure. This allows the structure to be, for example, washed, by hand or in a machine. The frame 22 can then be reinstalled between the layers 402 and 404.

As may be seen particularly in FIG. 78, handles 60 and 62 may be attached to the top side 410 of two opposing side panels 20. As discussed with regard to previous embodiments, the handles 60 and 62 are formed from a stretch-resistant material having a mesh web that extends between a portion of each strap side. It is to be understood that the handles for the present invention are not limited to the particular type shown in FIG. 78, but may include other designs as previously illustrated in FIGS. 9–12, by way of example.

As may be seen in FIG. 78, an optional storage pouch 70 may be formed from a foldable material, such as nylon mesh, and stitched to the side of one of the panels 20. As in the previously described embodiments, the storage pouch 70 is dimensioned to accommodate the structure 400 in its collapsed state.

Although stitching is presented as the preferred means for attaching or connecting the elements of the structure and permitting relatively convenient folding of the structure 400, it is to be understood that other attachment means may be used in this invention.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A collapsible structure having an open top, said collapsible structure comprising:

a plurality of adjacent panels, each one of said plurality of adjacent panels being stitched to adjacent ones of said plurality of adjacent panels, each one of said plurality of panels having a first layer and a second layer, the first layer comprising a non-interrupted web and the second layer comprising a web having an opening formed therein;

said first layer and said second layer cooperating to form a pocket therebetween; whereby said opening in said second layer provides access to an interior of said pocket;

a plurality of looped flexible frame members, each one of said plurality of frame members being respectively positioned in the pocket formed between said first layer and said second layer of a selected one of said plurality of panels and forming a side panel having at least a bottom side and two lateral sides; and a floor panel having a plurality of sides, each one of said plurality of sides being attached to a respective side panel bottom side.

2. The collapsible structure of claim 1 further including frame stitching, said frame stitching extending through said first layer and said second layer and being substantially parallel to and located adjacent to said frame member.

3. The collapsible structure of claim 1 further including a pair of substantially parallel lines of stitching, said lines of stitching extending through said first layer and said second layer and being substantially parallel to said frame member, the frame member being located between each member of said pair of parallel lines of stitching.

4. The collapsible structure of claim 1 further comprising at least one handle member, said handle member being secured to at least one of said side panels.

5. The collapsible structure of claim 1 further comprising at least one handle member, said handle member being secured to at least one of said frame members.

6. The collapsible structure of claim 1 further including a storage pouch, said storage pouch being coupled to one of said side panels near said open top.

7. The collapsible structure of claim 1 wherein said looped frame forms a continuous loop.

8. A collapsible structure having an open top, said structure comprising:

a plurality of adjacent side panels, each one of said plurality of adjacent side panels being stitched to adjacent ones of said plurality of adjacent side panels, each side panel including a two-ply web, and a looped frame;

the two-ply web including a first layer and a second layer cooperating to form a pocket therebetween, the first layer comprises a non-interrupted web and the second layer comprises a web having an opening formed therein; whereby said opening in said second layer provides access to an interior of said pocket;

the frame being positioned in the pocket between the first layer and the second layer of the web.

9. The collapsible structure of claim 8 further including frame stitching, said frame stitching extending through said first layer and said second layer and being substantially parallel to and located adjacent to said frame member.

10. The collapsible structure of claim 8 further including a pair of substantially parallel lines of stitching, said lines of stitching extending through said first layer and said second layer and being substantially parallel to said frame member, the frame member being located between each member of said pair of parallel lines of stitching.

11. The collapsible structure of claim 8 further comprising at least one handle member, said handle member being secured to at least one of said side panels.

12. The collapsible structure of claim 8 further comprising at least one handle member, said handle member being secured to at least one of said frame members.

13. The collapsible structure of claim 8 further including a storage pouch, said storage pouch being coupled to one of said side panels near said open top.

14. The collapsible structure of claim 8 wherein said looped frame forms a continuous loop.

* * * * *

UNITED STATES PATENT AND TRADEMARK OFFICE

CERTIFICATE OF CORRECTION

PATENT NO. : 6,948,632 B2
APPLICATION NO. : 10/413925
DATED : September 27, 2005
INVENTOR(S) : Michael S. Kellogg and Dean B. Krotts It is certified that error appears in the above-identified patent and that said Letters Patent is hereby corrected as shown below:

On the title page item (56), under "Other Publications" insert the following publications:

-- "Magic Maaze" Frontgate Mail-Order Catalog, Summer 1995, pg. 32 --
-- "Playhut Brochure" date unknown --

Signed and Sealed this

Third Day of June, 2008

JON W. DUDAS
*Director of the United States Patent and Trademark Office*